US007407457B2

(12) United States Patent
Dollins

(10) Patent No.: US 7,407,457 B2
(45) Date of Patent: Aug. 5, 2008

(54) RACKET BUMPER GUARD

(76) Inventor: Jeffrey David Dollins, 537 Inverlochy Dr., Fallbrook, CA (US) 92028

( * ) Notice: Subject to any disclaimer, the term of this patent is extended or adjusted under 35 U.S.C. 154(b) by 275 days.

(21) Appl. No.: 11/120,819

(22) Filed: May 3, 2005

(65) Prior Publication Data

US 2006/0252584 A1 Nov. 9, 2006

(51) Int. Cl.
*A63B 49/14* (2006.01)

(52) U.S. Cl. ..... 473/548

(58) Field of Classification Search ..... 473/553, 473/539, 548

See application file for complete search history.

(56) References Cited

U.S. PATENT DOCUMENTS

| | | | | | |
|---|---|---|---|---|---|
| 2,361,506 | A | | 10/1944 | Smith | |
| 2,838,054 | A | * | 6/1958 | Fischer | 132/246 |
| 3,330,560 | A | | 7/1967 | Higdon | |
| 3,597,803 | A | | 8/1971 | Van Neil | |
| 3,913,911 | A | * | 10/1975 | Peterson | 473/519 |
| 4,019,736 | A | | 4/1977 | Lehew | |
| 4,192,506 | A | * | 3/1980 | Sofia | 473/548 |
| 4,204,681 | A | | 5/1980 | Hall, Jr. et al. | |
| 4,236,271 | A | * | 12/1980 | Martino | 15/246 |
| 4,293,130 | A | | 10/1981 | Beranek | |
| 4,496,152 | A | | 1/1985 | Mott | |
| 4,776,592 | A | | 10/1988 | Umlauft et al. | |
| 4,779,869 | A | | 10/1988 | Spann | |
| 4,889,337 | A | | 12/1989 | Todd | |
| D314,028 | S | | 1/1991 | Davis | |
| 5,029,859 | A | | 7/1991 | Davis | |
| 5,083,777 | A | * | 1/1992 | Held | 473/437 |
| 5,092,593 | A | | 3/1992 | Williams et al. | |
| 5,098,099 | A | | 3/1992 | Liu | |
| 5,102,132 | A | | 4/1992 | Chen | |
| 5,165,687 | A | | 11/1992 | Soong | |
| 5,232,219 | A | | 8/1993 | Tseng | |
| 5,290,031 | A | | 3/1994 | Natsume | |
| 5,362,071 | A | | 11/1994 | Liu | |
| 5,944,625 | A | | 8/1999 | Janes | |

* cited by examiner

*Primary Examiner*—Raleigh W. Chiu
(74) *Attorney, Agent, or Firm*—Law Office of Gerald Maliszewski; Gerald Maliszewski

(57) ABSTRACT

A racket frame guard assembly is provided. The assembly includes a flexible abrasion-resistant section (ARS) for covering an outside portion of a racket frame, and a collar with a fastener cavity, formed with the ARS. The assembly also includes either a separate or attached fastener strip, insertible through the collar fastener cavity, having a length sufficient to wrap around a radial circumference of the racket frame. The fastener strip is used to secure the ARS to a racket frame. For example, the fastener strip can be a tie wrap, Velcro tie, or even a twist tie. Typically, the ARS has a tubular-shape with an inside surface formed along an interior axis, and the collar fastener cavity is formed by the ARS inside surface. The ARS inside surface can be an inside cylinder surface or a rectangular slit for example.

15 Claims, 29 Drawing Sheets

RACKET BUMPER GUARD

BACKGROUND OF THE INVENTION

1. Field of the Invention

This invention generally relates to sporting goods and, more particularly, to a frame bumper guard for protecting the head of a racket from skinning, abrasions, and stresses associated with unintentionally contacting a court surface.

2. Description of the Related Art

In games that involve the use of a racket and ball, such as tennis, squash, and racquetball, there is inevitable wear and tear induced on the racket frame as a result of the racket striking the playing surface. With enough contact, the frame becomes worn and may even crack. When sufficient wear is induced, the frame may collapse as a result of impacting a ball, or stringing the racket with new strings. In fact, many rackets are constructed with a plastic or rubber-like guard on the head of racket to address this problem. These products are very effective for a period of time. However, most participants in these types of games have a tendency, due to a swing style or play habits for example, to scrape or wear in fairly specific and consistent places along the frame. Once the guard becomes worn, the frame is exposed. The conventional guard that comes with the racket is held in place by the strings and, therefore, cannot be relocated. The entire guard needs to be completely replaced by re-stringing the racket, even though only a small portion of the guard may be worn.

Since new rackets are constantly being introduced to the market, and old racket designs withdrawn, it is likely that replacements are unavailable when it becomes time to replace a worn guard. Many a player has had to retire a beloved set of rackets, or use their rackets until they break, only because they could not find replacement racket head guards.

There are some after-market protection devices that have been introduced as a replacement, or as an augmentation to the guard systems that come standard with most rackets. For example, a "head tape" exists that can be attached to the frame. The "head tape" is easily applied to any location on the frame, but is not very durable. Another device uses a long plastic filament that spiral wraps around the frame or is secured by using a winding tie, both of which span an extended length along the top of the frame. However, this system requires the replacement of the entire length, even if only a portion of the device is worn. The long length and added coverage also creates additional, unnecessary weight.

Another conventional protection system is described in U.S. Pat. No. 4,293,130, Beranek. This patent uses a one-piece reinforced tie wrap-like device. This single-piece system is designed with a uniform thickness that extends the length of the device. The device thickness protects the exterior portion of the frame. However, the device is thicker than necessary on the interior portion of the frame where the opposite ends mate. The thickness prevents the device from being tightly secured. As a result, the device is likely to spin on the frame, and is unlikely to remain secured over the frame region needing the protection.

It would be advantageous if a frame guard could be secured to specific regions of a racket head needing protection.

It would be advantageous if the above-mentioned frame guard could be secured to the racket overlying the racket strings, or without having to restring the racket.

SUMMARY OF THE INVENTION

The present invention is a protective device or guard for preventing damage to specific areas of a racket frame in the event that the racket strikes the playing surface. The present invention guard overcomes the disadvantages of the above-mentioned conventional guards. The protective device is an assembly that includes an elongated strip of flexible material, with a fastening system, combined with a flexible reinforced abrasion resistant section (ARS) that is positioned by the fastening strip. The assembly can then be secured by looping around any desired area of the racket frame. The ARS can be positioned on the exterior edge of the frame with the fastening portion of the strip located on the interior edge. The combination of a secure fastening system strip, with the ARS, permits a secure fit to the racket and a durable, lightweight guard that can be positioned in any number of locations along the frame.

Accordingly, a racket frame guard assembly is provided. The assembly comprises a flexible abrasion-resistant section (ARS) for covering an outside portion of a racket frame, and a collar with a fastener cavity, formed with the ARS. The assembly also includes a fastener strip, insertible through the collar fastener cavity, having a length sufficient to wrap around a radial circumference of the racket frame. The fastener strip is used to secure the ARS to a racket frame. For example, the fastener strip can be a tie wrap, Velcro tie, or even a twist tie.

In one aspect, the ARS has a tubular-shape with an inside surface formed along an interior axis, and the collar fastener cavity is formed by the ARS inside surface. The ARS inside surface can be an inside cylinder surface or a rectangular slit for example.

In one aspect, the ARS has a frame interface section with a first thickness between the ARS outside surface and the inside surface, and a contact section with a second thickness between the inside and outside surfaces, greater than the first thickness. In this manner the ARS is made more flexible, for a more secure fit to the frame, without thinning the sacrificial contact section thickness. In another aspect, the frame interface section is made of a different material than the contact section. This permits the guard to be made shock absorbent. For example, the contact section can be made of a harder, more abrasion resistant material, while the frame interface section is made from a softer, more flexible shock absorbent material.

Additional details of the above mentioned assemble and a frame guard device are described in more detail below.

DETAILED DESCRIPTION

Figure 1B:
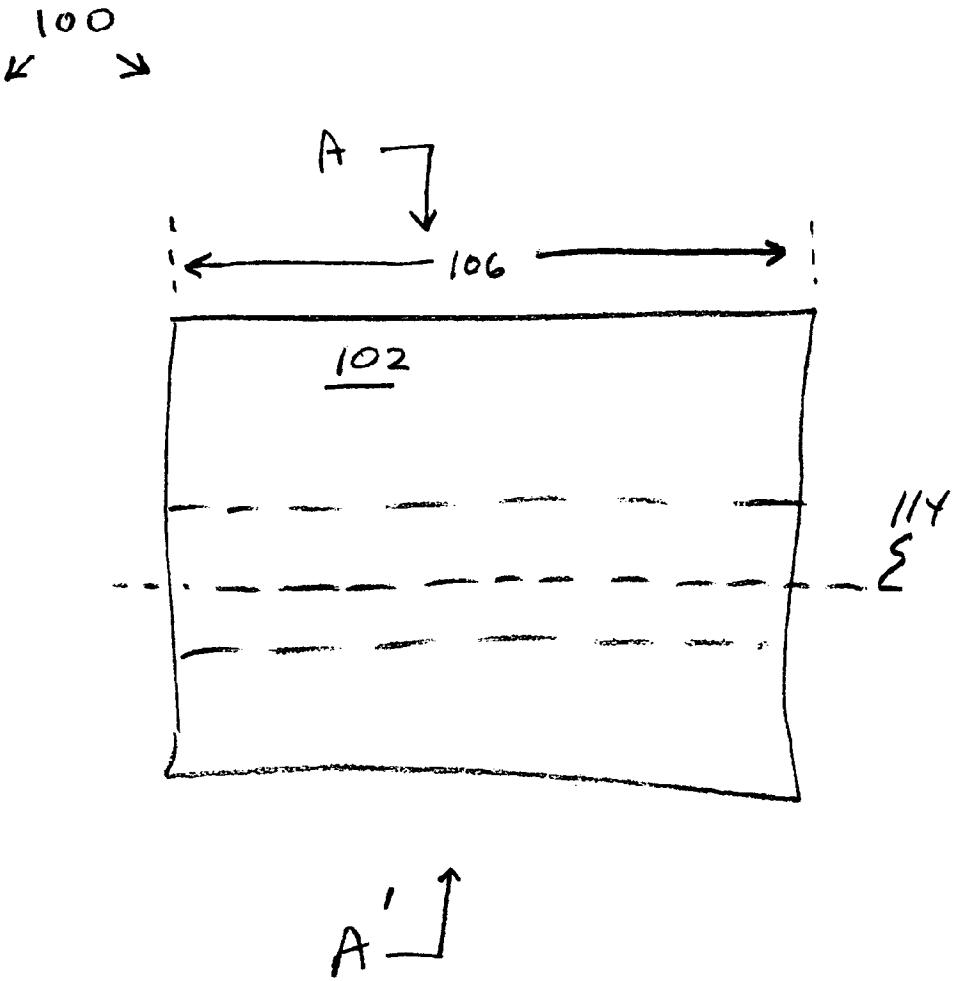
FIGS. 1A and 1B are orthogonal partial cross-sectional views of a racket frame bumper guard.
Figure 1A:
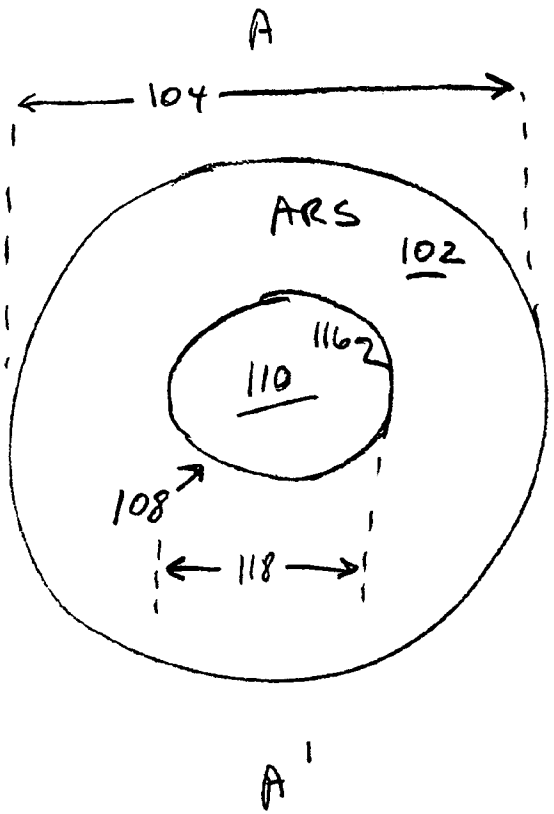
Figure 17B:
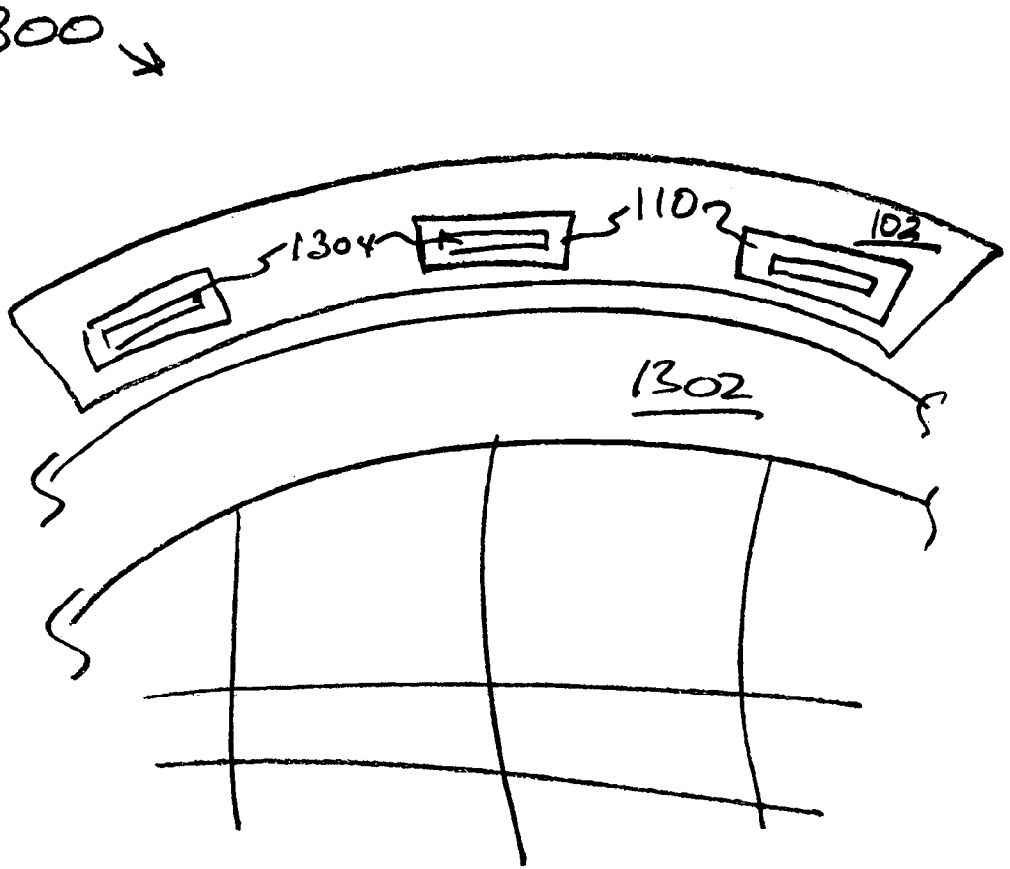
FIGS. 17A through 17D are orthogonal cross-sectional views of the parallel collar variation of the assembly.
Figure 17A:
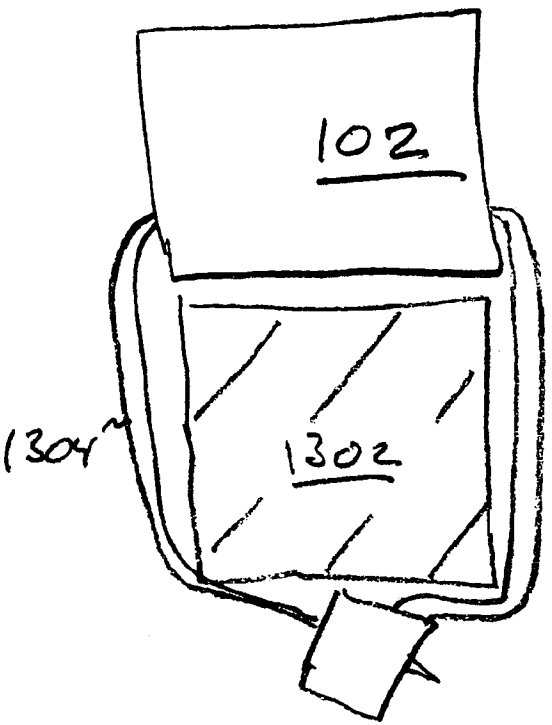

FIGS. 1A and 1B are orthogonal partial cross-sectional views of a racket frame bumper guard. The frame guard 100 comprises a flexible abrasion-resistant section (ARS) 102 for covering an outside portion of a racket frame. The frame guard 100 has a collar 108 with a fastener cavity 110, formed with the ARS 102, for accepting a fastener strip (see FIGS. 13A and 13B). Typically, the ARS 102 has an outside surface diameter 104 of about 9/32 to 1 inches, and an outside surface length 106 in the range of 1 to 2 inches. However, the guard is not necessarily limited to just these dimensions. For example, the ARS of FIG. 17B typically has an outside surface diameter (width) that is greater than 1 inch, and may be several inches. The ARS 102 can be a material such as polyurethane, a thermal plastic, or a cast polyurethane plastic. However, other materials would be known to those skilled in the art, and the frame guard 100 is not limited to any particular materials.

In one aspect as shown, the ARS 102 has a tubular, or cylindrical-shape with an inside surface formed along an interior axis 114. Then, the collar fastener cavity 110 is formed by the ARS inside surface 116. Also as shown, the ARS inside surface 110 is an inside cylinder surface. The inside surface has a diameter, or width 118. Alternately but not shown, the ARS 102 can have a rectangular shape, regardless of the inside surface style.

Figure 2:
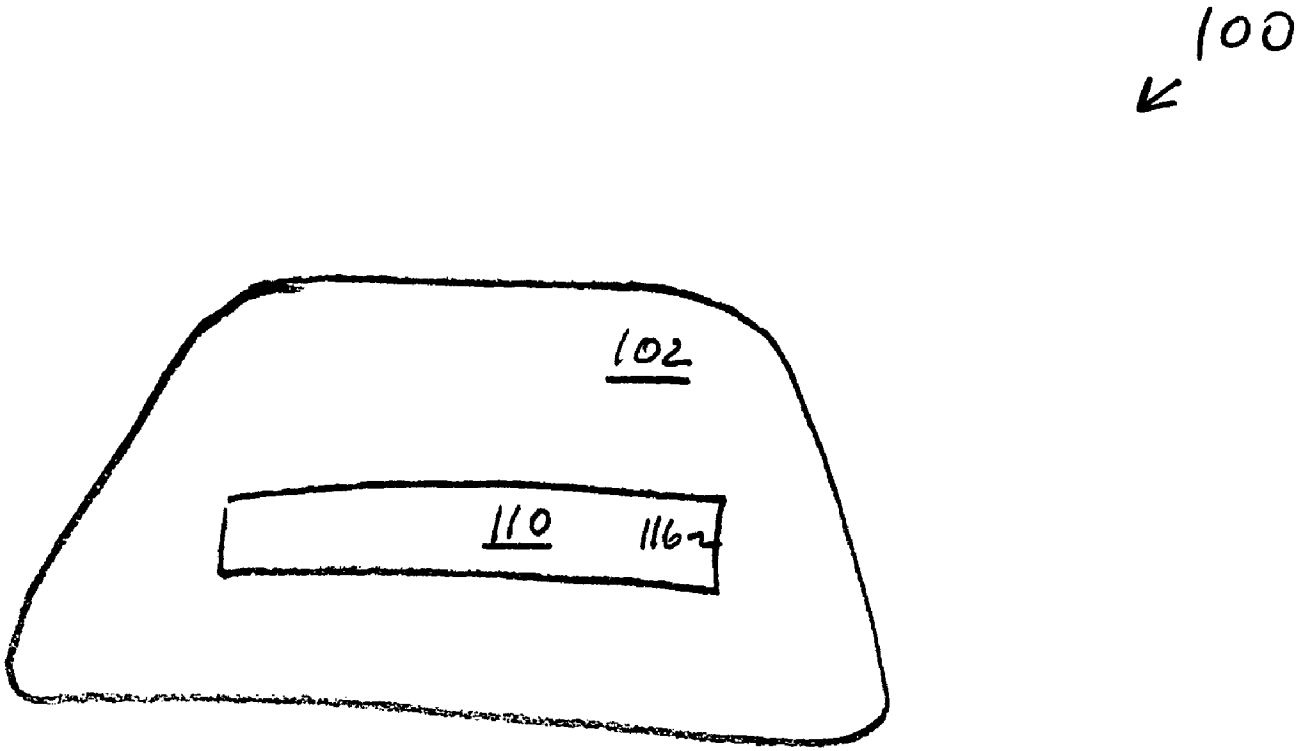
FIG. 2 is a partial cross-sectional view of a first variation of the frame guard of FIG. 1A.

FIG. 2 is a partial cross-sectional view of a first variation of the frame guard of FIG. 1A. In FIG. 2 the ARS inside surface 110 is a rectangular slit. That is, the fastener cavity 110 is rectangular. Alternately but not shown, the ARS inside surface 110 has an oval shape. The frame guard fastener cavity is not limited to any particular shape.

Figure 3:
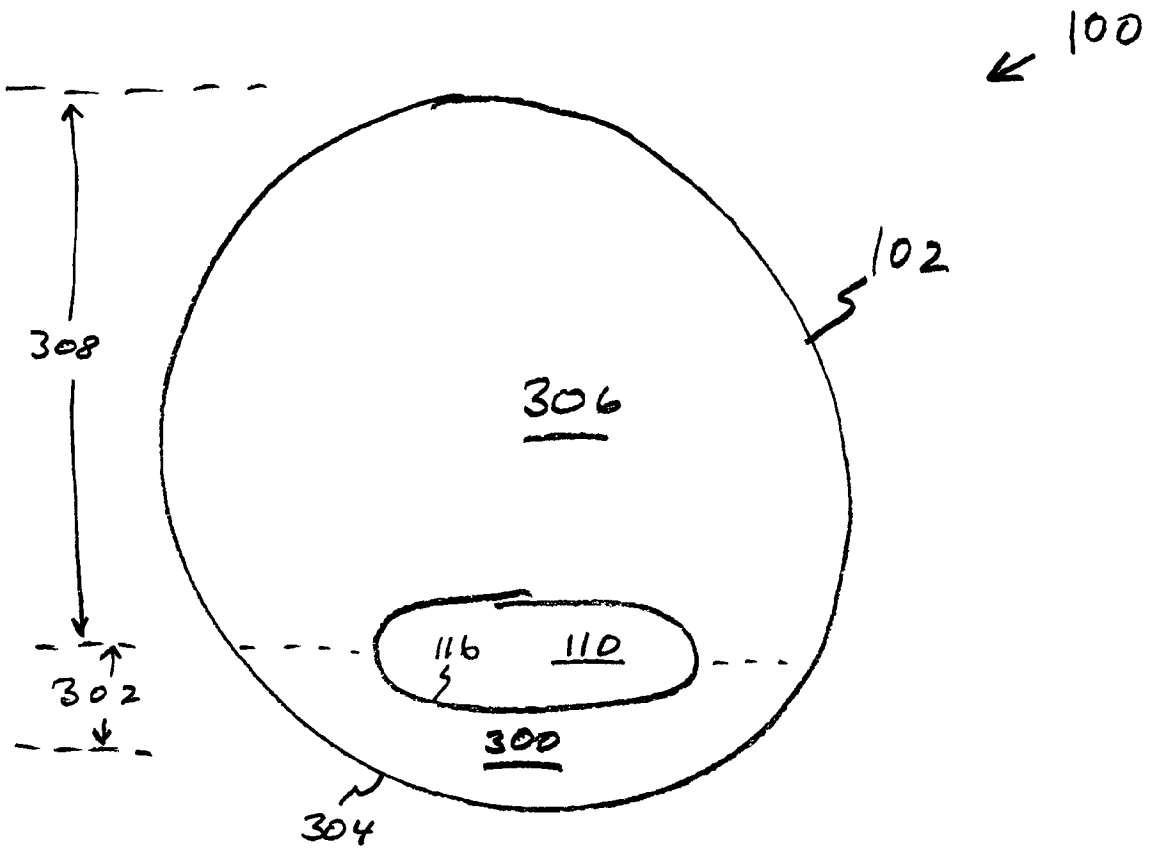
FIG. 3 is a partial cross-sectional view of a second variation of the frame guard of FIG. 1A.

FIG. 3 is a partial cross-sectional view of a second variation of the frame guard of FIG. 1A. In this aspect the ARS 102 has a frame interface section 300 with a first thickness 302 between an ARS outside surface 304 and the inside surface 116. The ARS 102 also has a contact section 306 with a second thickness 308 between the inside surface 116 and the outside surface 304. The second thickness 308 is greater than the first thickness 302. For example, if the ARS 102 has a tubular-shape, the different thicknesses can be formed by offsetting the inside surface 110 from the interior axis (see FIG. 1A). The advantage of the differential thicknesses 302/308 is that the frame interface section can be made thin for greater flexibility. As explained below, the frame interface section is mated to the racket frame, and greater flexibility results is a tighter fit to the racket, so the frame guard is more likely to remain where intended.

Figures 4A, 4B:
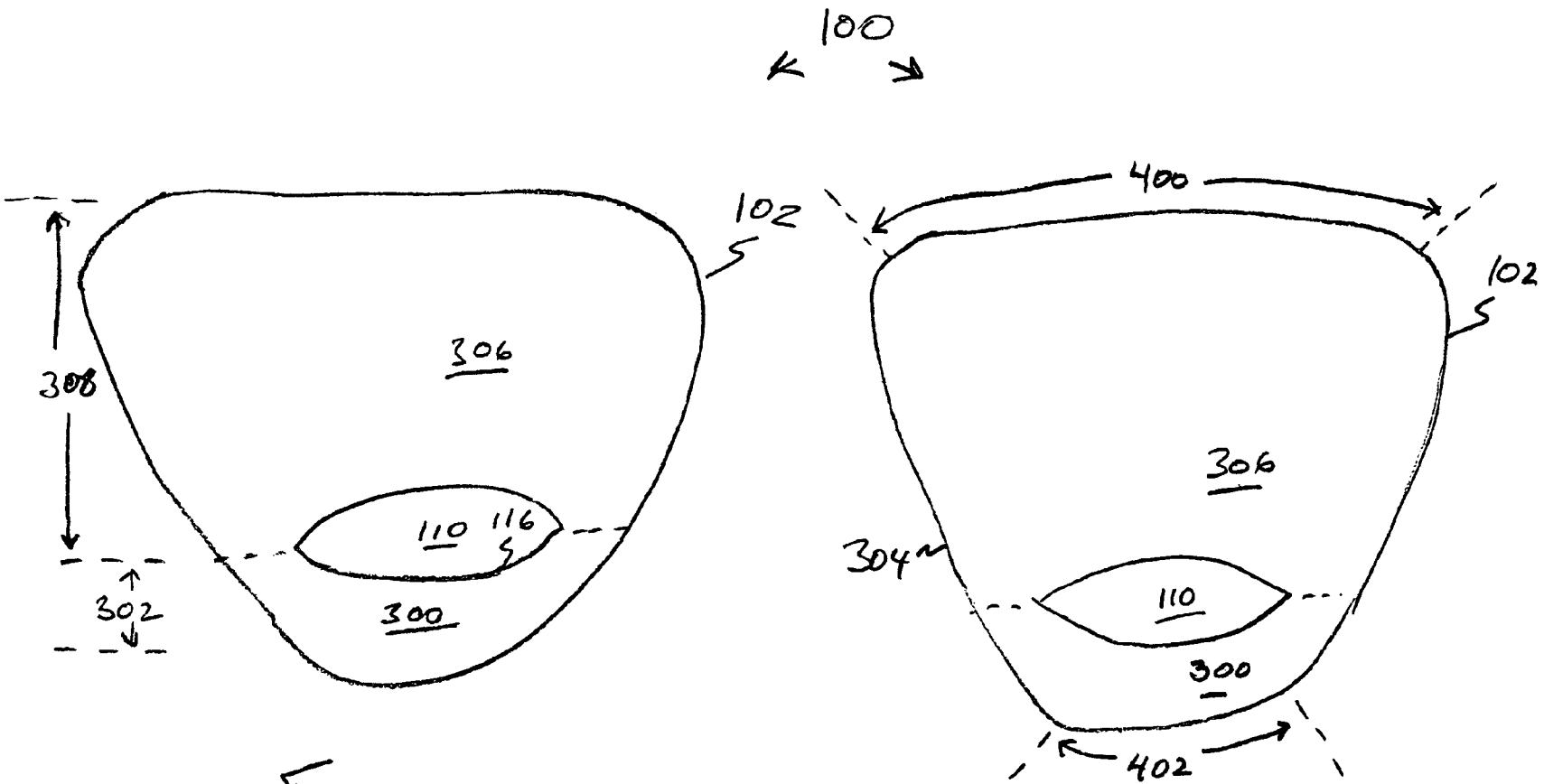
FIGS. 4A and 4B are partial cross-sectional views showing other aspects of the frame guard of FIG. 3.

FIGS. 4A and 4B are partial cross-sectional views showing other aspects of the frame guard of FIG. 3. Alternately, the different thicknesses 302/308 are obtained by making the making the ARS 102 an asymmetric cylinder shape (FIG. 4A). In FIG. 4B the ARS outside surface circumference 400 of the contact section 306 is greater than the ARS outside surface circumference 402 of the frame interface section 300. Note, the definition of outside surface circumference may vary depending on the shape of the ARS 102. As shown in FIG. 4B, the outside surface circumference 402 is the "top" surface of the ARS 102. Depending on shape, the sides of the ARS may also be considered a surface that is likely to make contact with a court (see FIG. 5B). This differential circumference is another means of making the ARS 102 more flexible, without sacrificing contact area. Alternately stated, the contact section outside surface area is greater than the frame interface section outside surface area. A frame guard with a larger contact section outside surface area is likely to last longer and wear slower. Although not specifically shown in this figure, there may be situations where it is desirable the ARS outside surface circumference of the contact section 306 is less than the ARS outside surface circumference of the frame interface section.

Figure 5B:
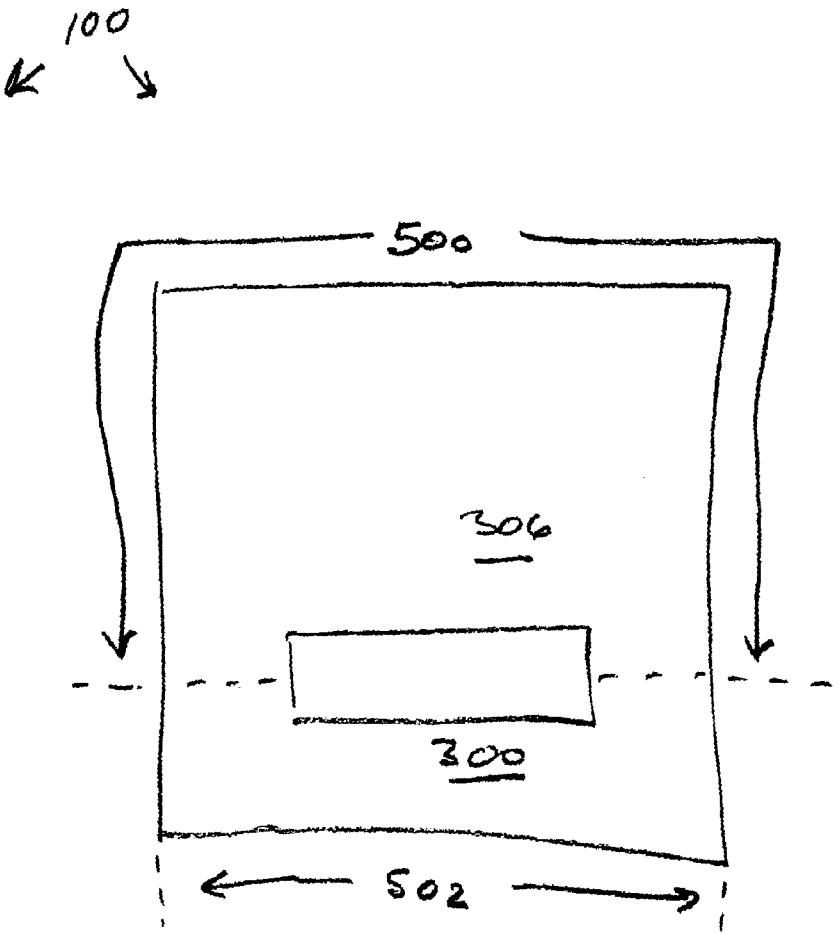
FIGS. 5A and 5B are partial cross-sectional views showing more aspects of the frame guard of FIG. 3.
Figure 5A:
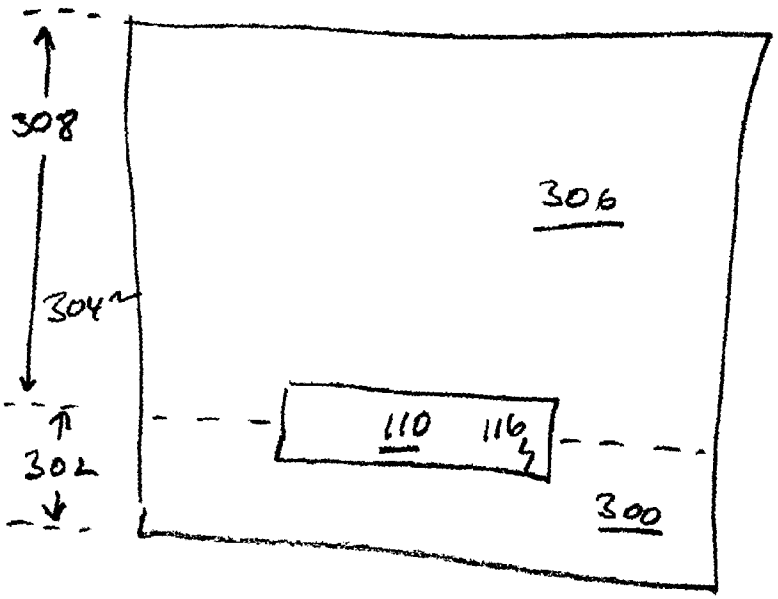

FIGS. 5A and 5B are partial cross-sectional views showing more aspects of the frame guard of FIG. 3. Here, the different thicknesses 302/308 are obtained by making the making the ARS asymmetrically rectangular (FIG. 5A). In FIG. 5B the ARS outside surface circumference 500 of the contact section 306 is greater than the ARS outside surface circumference 502 of the frame interface section 300. This differential circumference is another means of making the ARS 102 more flexible, without sacrificing contact area. Alternately stated, the contact section outside surface area is greater than the frame interface section outside surface area.

Figure 6B:
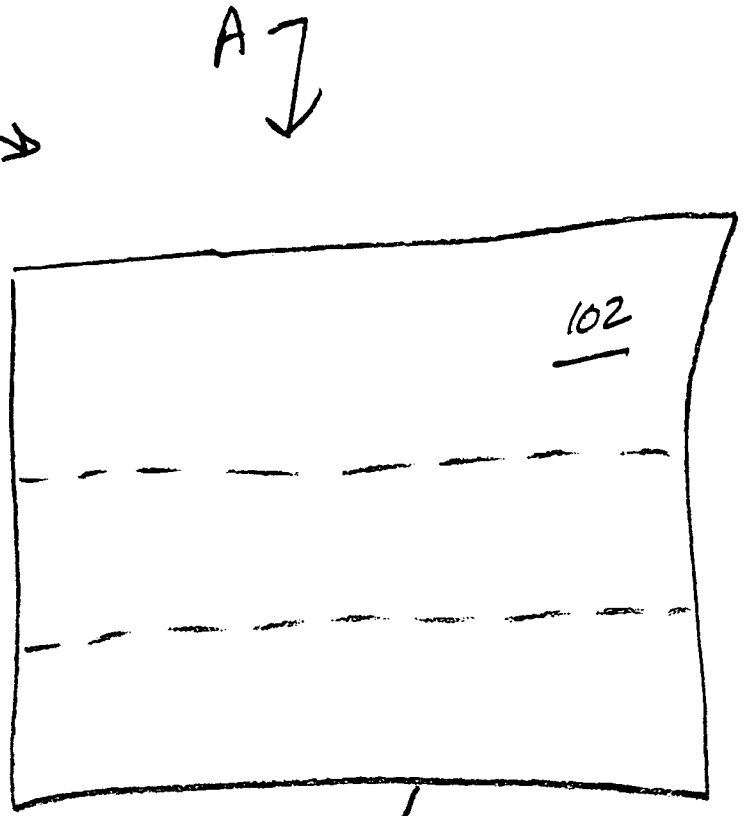
FIGS. 6A and 6B are partial cross-sectional views of a third variation of the frame guard of FIGS. 1A and 1B.
Figure 6A:
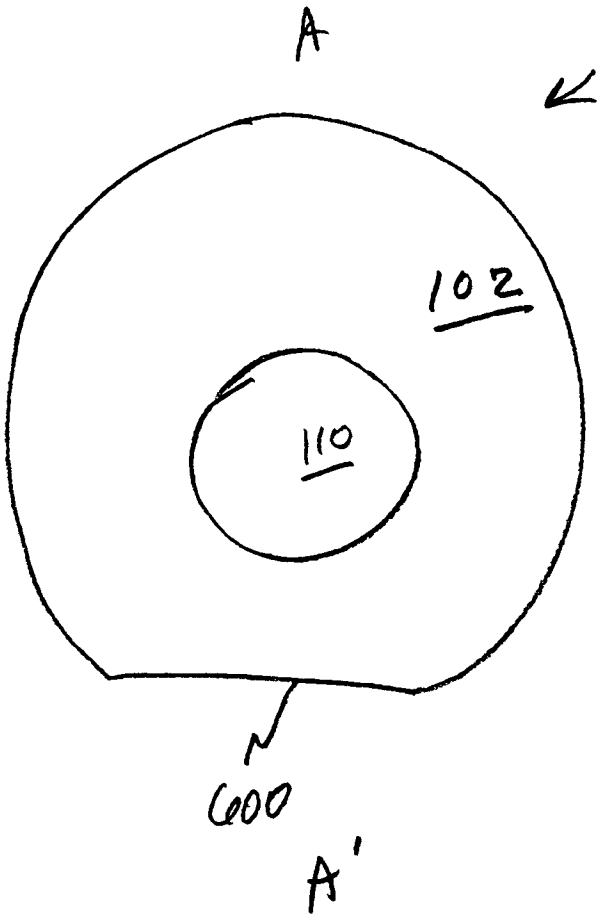

FIGS. 6A and 6B are partial cross-sectional views of a third variation of the frame guard of FIGS. 1A and 1B. As shown is FIG. 6A, the ARS 102 is tubular-shaped. In addition, the ARS frame interface section outside surface 600 is flat, or substantially flat. Once again, this aspect may enable the ARS to be mated more tightly with a racket frame. The frame guard of FIG. 6B is essentially the guard of FIG. 3, with a flat, or substantially flat frame interface section outside surface 600.

Figure 7B:
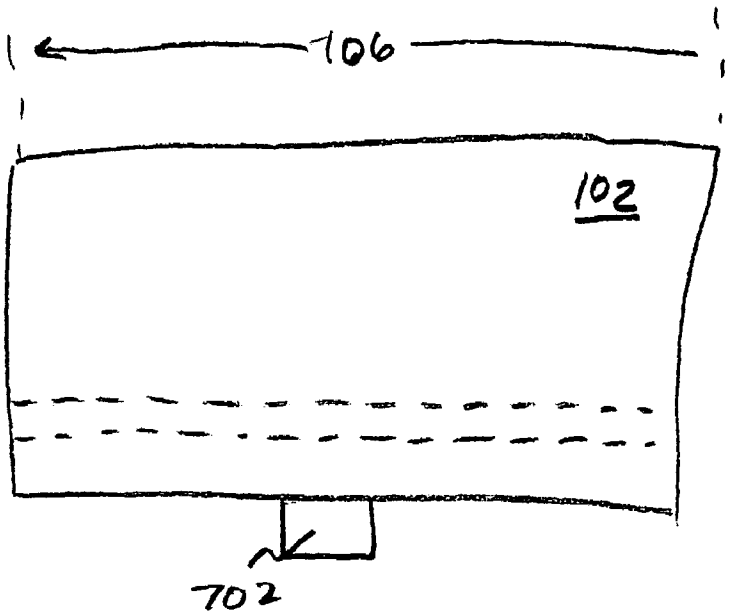
FIGS. 7A and 7B are orthogonal partial cross-sectional views of a fourth variation of the frame guard of FIGS. 1A and 1B.
Figure 7A:
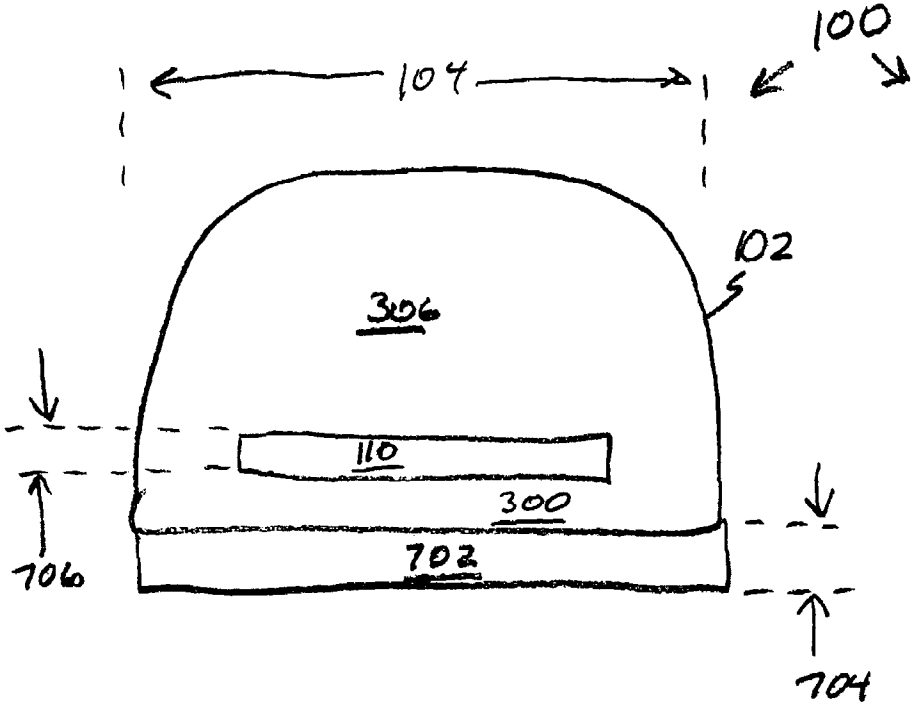

FIGS. 7A and 7B are orthogonal partial cross-sectional views of a fourth variation of the frame guard of FIGS. 1A and 1B. The ARS 102 has a loaf-shape where the contact section 306 is thicker than the frame interface section 300. The fastener cavity 110 is rectangular. The ARS 102 has an outside surface length 106. The racket frame guard 100 further comprises a groove flange 702 extending from the outside surface 304. The groove flange 702 bisects the outside surface length 106. In this example the flange 702 has a height 704 of about ⅛ inches, the ARS length 106 is about 1¾ inches, the cavity height 706 is about 0.4 inches, and the ARS outside surface diameter (width) 104 is about 9/32 inches. The groove flange 702 is used for securing the ARS 102 to a groove that is in the frame outside portion of a typical tennis racket. The frame guard 100 is more likely to remain where intended on the racket frame once the groove flange 702 aligned in the groove. In other aspects not shown, the ARS may have an alternate shape, slit style, or section thicknesses as described above.

Figure 8B:
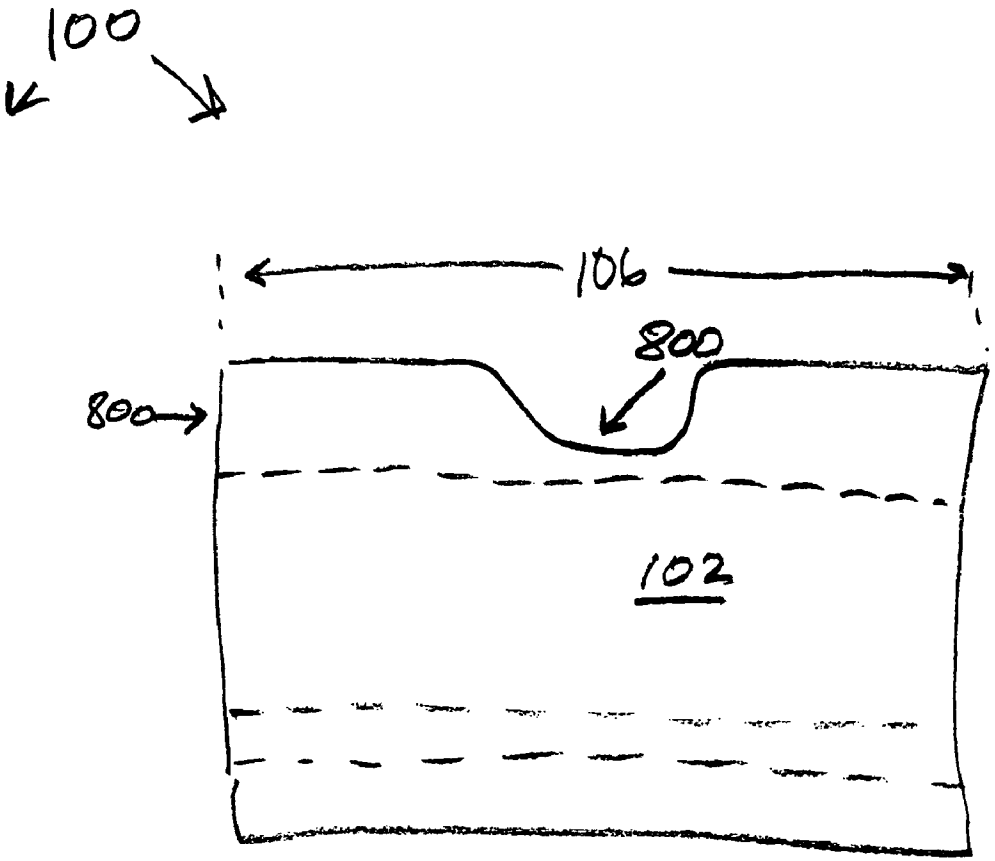
FIGS. 8A and 8B are orthogonal partial cross-sectional views of a fifth variation of the frame guard of FIGS. 1A and 1B.
Figure 8A:
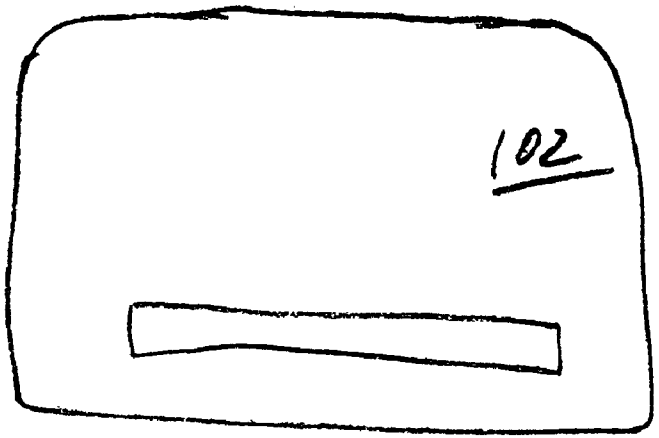

FIGS. 8A and 8B are orthogonal partial cross-sectional views of a fifth variation of the frame guard of FIGS. 1A and 1B. The ARS 102 has a string channel 800 formed in the outside surface length 106, for accepting a racket string. For ease in the process of restringing a racket, this feature permits the frame guard to optionally be left in place while the racket is being restrung. The ARS is shown as the loaf-shape of FIGS. 7A and 7B. However in other aspects not shown, the ARS may have an alternate shape, slit style, or section thicknesses as described above.

Figure 8C:
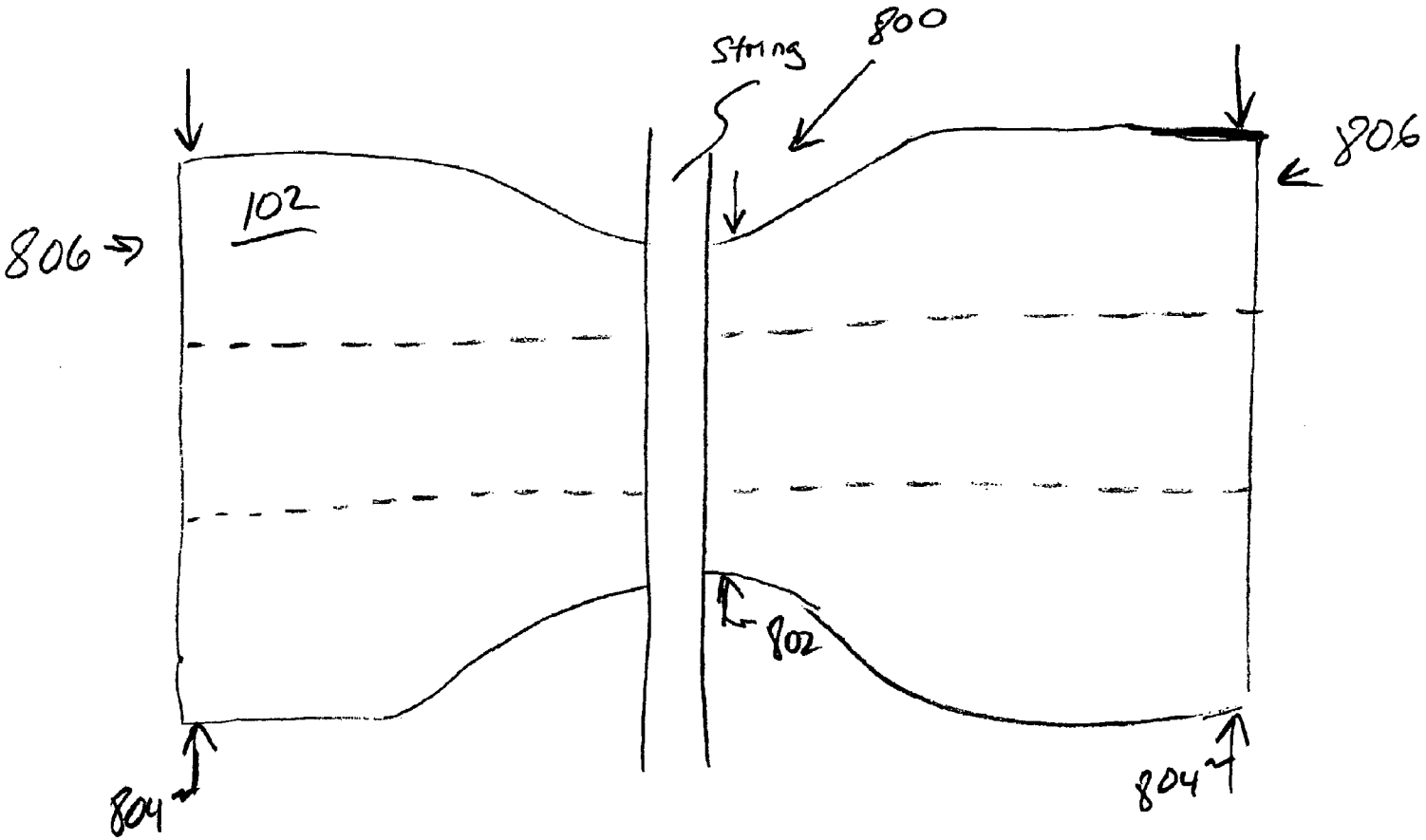
FIG. 8C is a plan, top view showing a different aspect of the string channel of FIG. 8B.

FIG. 8C is a plan, top view showing a different aspect of the string channel of FIG. 8B. In this aspect, the ARS 102 is formed with an hourglass shape (as seen from the top), so that the center cross-section (width) 802 of the ARS 102, is less than width 804 at the ends 806 of the ARS 102. Note, the center width 802 need not symmetric. That is, the center cross-section in the vertical direction (coming out of the page), may or may not be the same width as the ARS ends 806.

Figure 9:
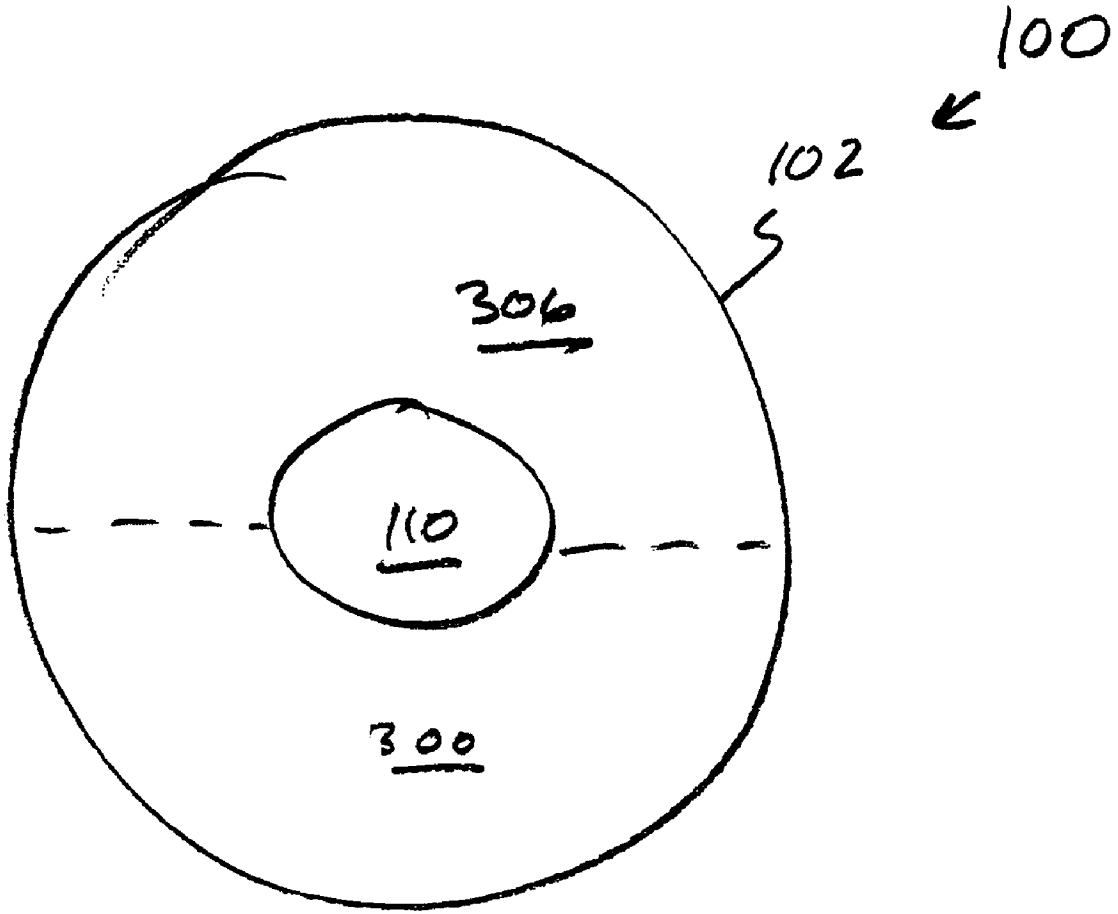
FIG. 9 is a partial cross-sectional view of a sixth variation of the frame guard of FIG. 1A.

FIG. 9 is a partial cross-sectional view of a sixth variation of the frame guard of FIG. 1A. In this aspect the ARS 102 frame interface section 300 is made from a first material, and the contact section 306, made with a second material. For example, the first material can be chosen for flexibility or shock absorption, while second material is chosen for durability. The ARS is shown as the tubular variation of FIGS. 1A and 1B. However, in other aspects not shown, the ARS may have an alternate shape, slit style, or section thicknesses as described above.

Figure 10A:
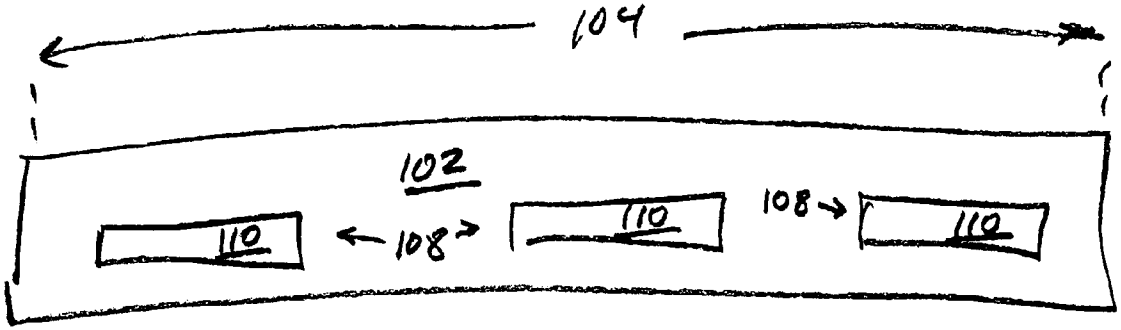
FIGS. 10A and 10B are orthogonal partial cross-sectional views of a seventh variation of the frame guard of FIGS. 1A and 1B.
Figure 10B:
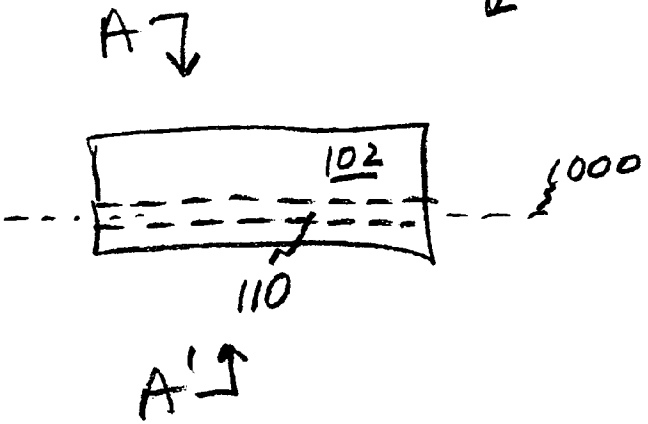

FIGS. 10A and 10B are orthogonal partial cross-sectional views of a seventh variation of the frame guard of FIGS. 1A and 1B. In this aspect, a plurality of collars 108 and corresponding collar fastener cavities 110 are formed in the ARS 102. The plurality of collar fastener cavities 110 is aligned along parallel axes 1000. Shown are three parallel collar fastener cavities 110. However, the guard 100 is not limited to any particular number of cavities. The ARS is shown as tubular-shaped. However, in other aspects not shown, the ARS may have an alternate shape, slit style, or section thicknesses as described above. This arrangement permits the ARS to be especially wide (104), to cover a broader expanse of racket frame.

Figure 11B:
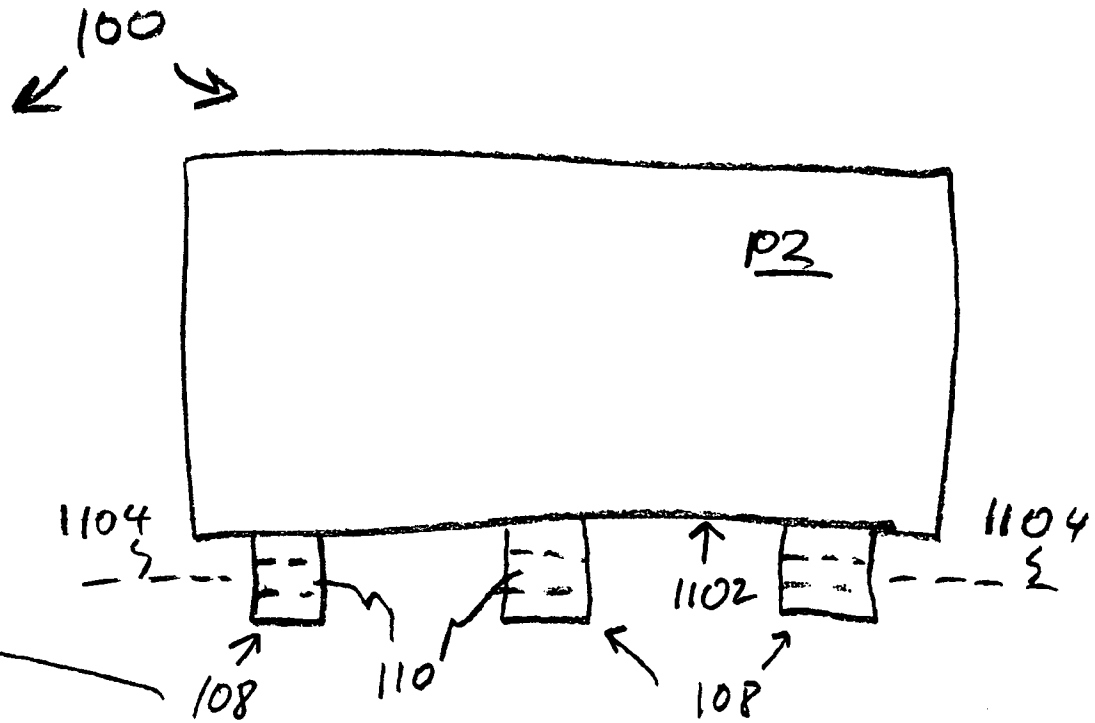
FIGS. 11A and 11B are orthogonal partial cross-sectional views of another aspect of the frame guard of FIGS. 1A and 1B.
Figure 11A:
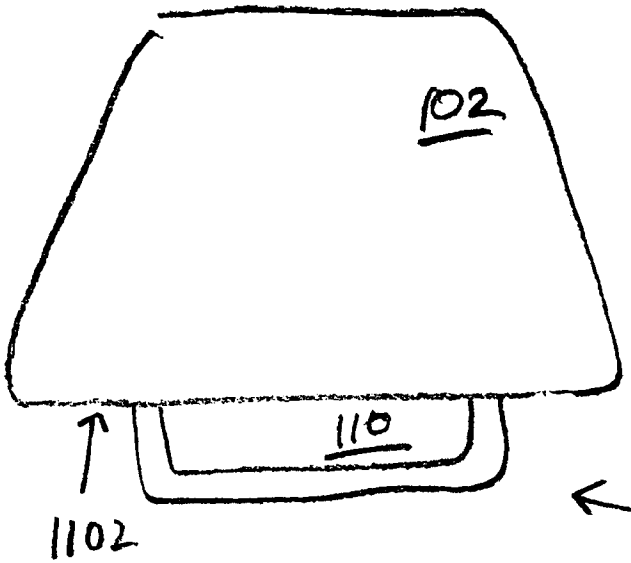

FIGS. 11A and 11B are orthogonal partial cross-sectional views of another aspect of the frame guard of FIGS. 1A and 1B. As shown, the ARS 102 has a frame interface surface 1102. A variety of ARS shapes are possible. A plurality of collars 108 extend as flanges from the frame interface surface 1102. A plurality of collar fastener cavities 110 is aligned along a single axis 1104, cooperating to accept a fastener strip.

Figure 12:
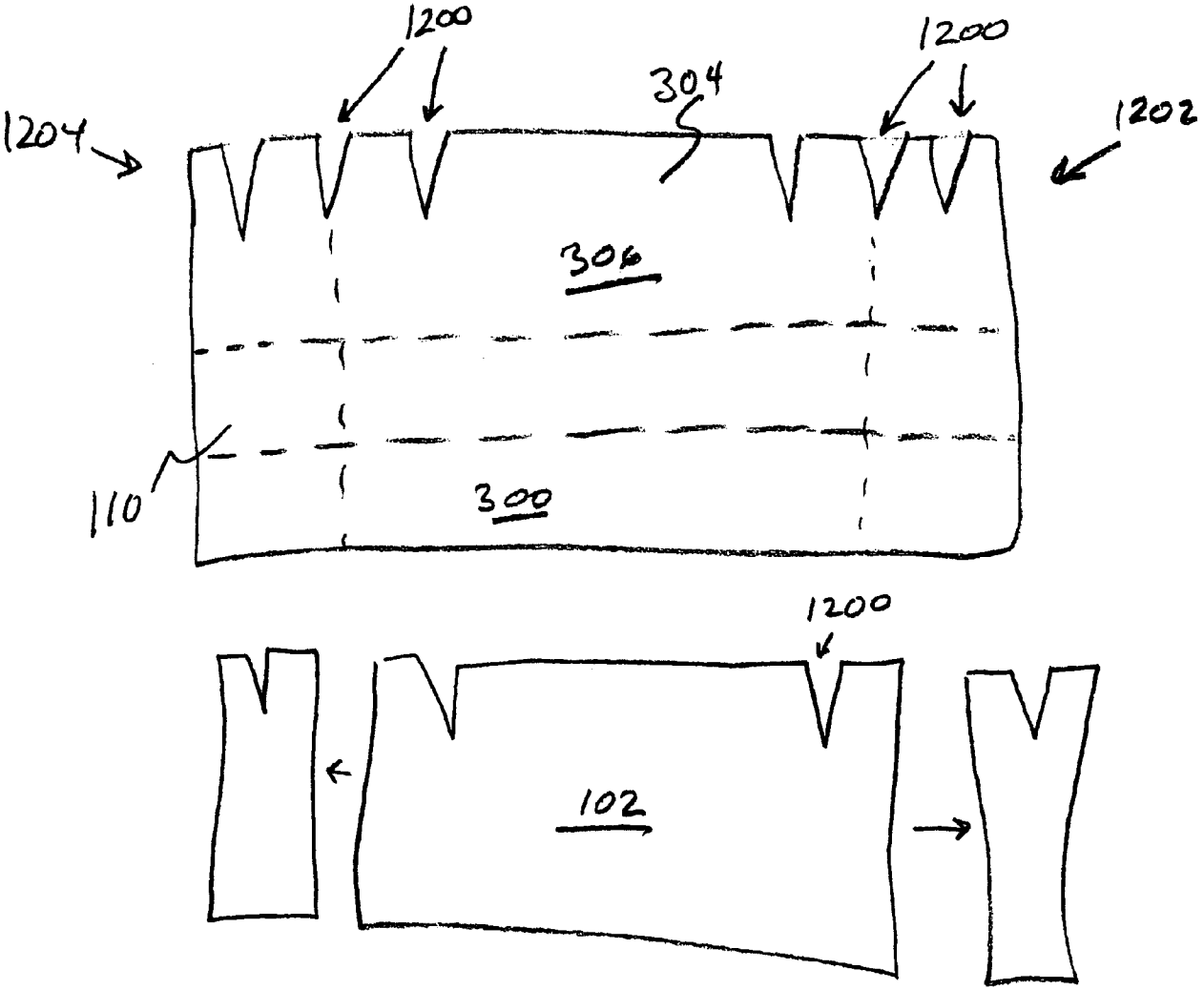
FIG. 12 is a partial cross-sectional view of a seventh variation of the frame guard of FIG. 1B.

FIG. 12 is a partial cross-sectional view of a seventh variation of the frame guard of FIG. 1B. In this aspect, notches 1200 are formed in the outside surface 304. The notches can be formed on both ends 1202 and 1204 of the frame guard as shown, or just on one of the ends (not shown). The notches 1200 can be formed on just the outside surface of the contact section 306 as shown, on just the outside surface of the frame interface section 300 (not shown), or completely around the circumference of both the contact and frame interface sections (not shown). This feature permits the guard outside surface length to be more easily shortened by cutting or breaking the guard along a notch 1200. In this manner, the guard is tailored to fit different racket frame dimensions. The ARS is shown as the tubular variation of FIGS. 1A and 1B. However, in other aspects not shown, the ARS may have an alternate shape, slit style, or section thicknesses as described above.

Figure 13A:
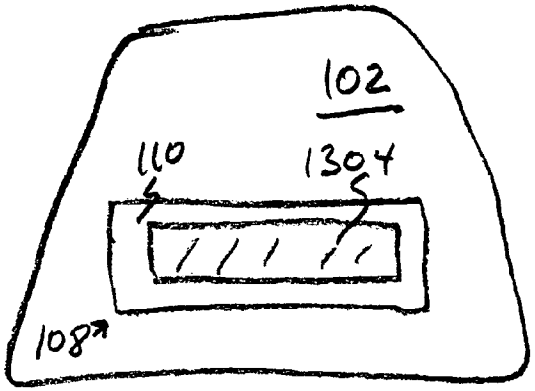
FIGS. 13A and 13B are orthogonal cross-sectional views of a racket frame guard assembly.
Figure 13B:
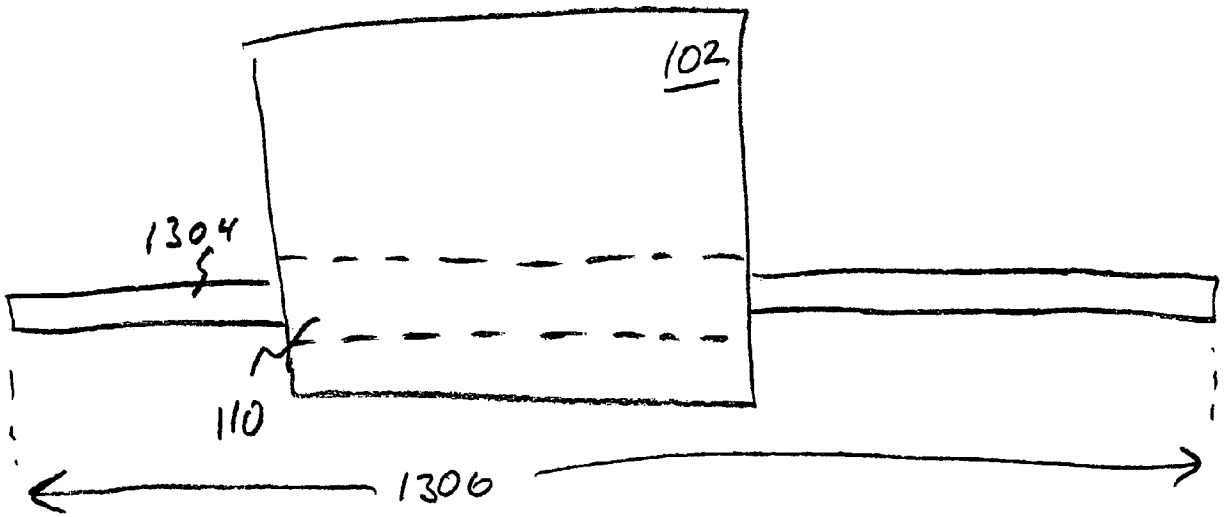

FIGS. 13A and 13B are orthogonal cross-sectional views of a racket frame guard assembly. The assembly 1300 comprises a flexible abrasion-resistant section (ARS) 102 for covering an outside portion of a racket frame. A collar 108 with a fastener cavity 110 is formed with the ARS 102. A fastener strip 1304 is insertible through the collar fastener cavity 110. The fastener strip 1304 has a length 1306 sufficient to wrap around a radial circumference of a racket frame, to secure the ARS 102. The fastener strip 1304 can be a conventional device such as a cable tie, tie wrap, a hose clamp, a twist tie, Velcro strip, Velcro tie wrap, a wire, or a string. Other similar clamping mechanisms would be known by those skilled in the art. The assembly fastener strip 1304 is not limited to any particular style or material.

The ARS 102 of FIGS. 13A and 13B is essentially the same as the ARS of FIGS. 1A and 1B. The assembly 1300 can be formed using any of the ARS variations explained above and shown in FIGS. 1A through 9B, with a single fastener strip 1304. In the interest of brevity therefore, not every ARS variation will be repeated.

Generally, the ARS has been described as part of an assembly that protects a racket from contact with a court. However, in other aspects, the ARS material is chosen solely for its shock absorption qualities. In this manner the ARS performs a function similar to a conventional string dampener, which absorbs the impact of a ball striking the racket. Unlike the embodiment shown in FIG. 5A for example, in this aspect the guard frame interface section may be made thicker than the so-called contact section, since the guard is not being applied as a scrape-protector. In this aspect, the ARS may be mounted either on the outside portion of the racket as shown in the figures described below, or on the inside portion of the racket adjacent the strings (not shown).

Figure 14B:
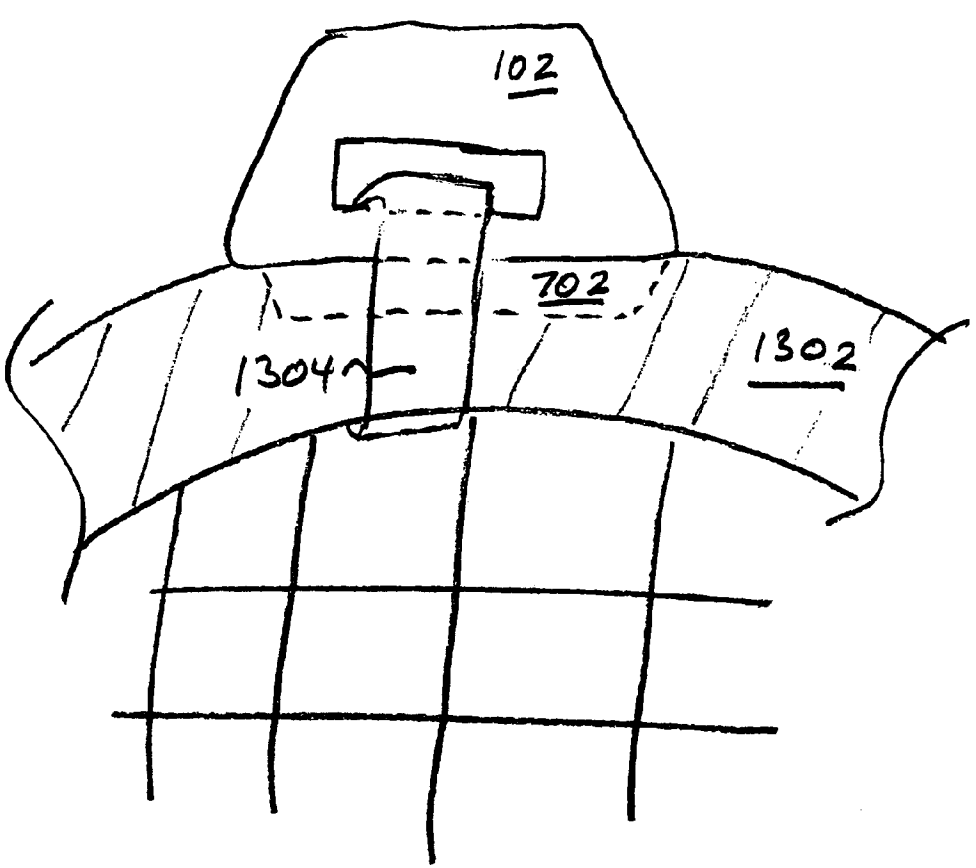
FIGS. 14A and 14B are orthogonal cross-sectional and side views of the groove flange variation of the assembly.
Figure 14A:
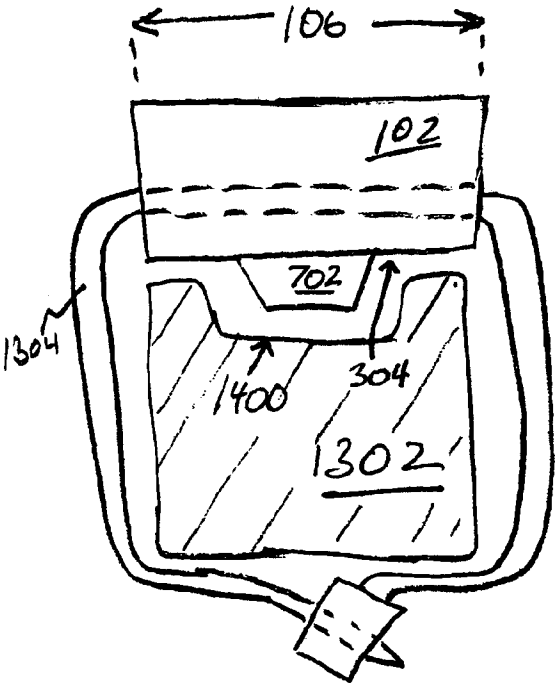

FIGS. 14A and 14B are orthogonal cross-sectional and side views of the groove flange variation of the assembly. The ARS 102 has an outside surface length 106. A groove flange 702 extends from the outside surface 304, bisecting the outside surface length 106, for securing the ARS 102 to a groove 1400 in the outside portion of a racket frame 1302. The cross-section of the racket frame seen in FIG. 14A defines a radial circumference of the frame.

Figure 15B:
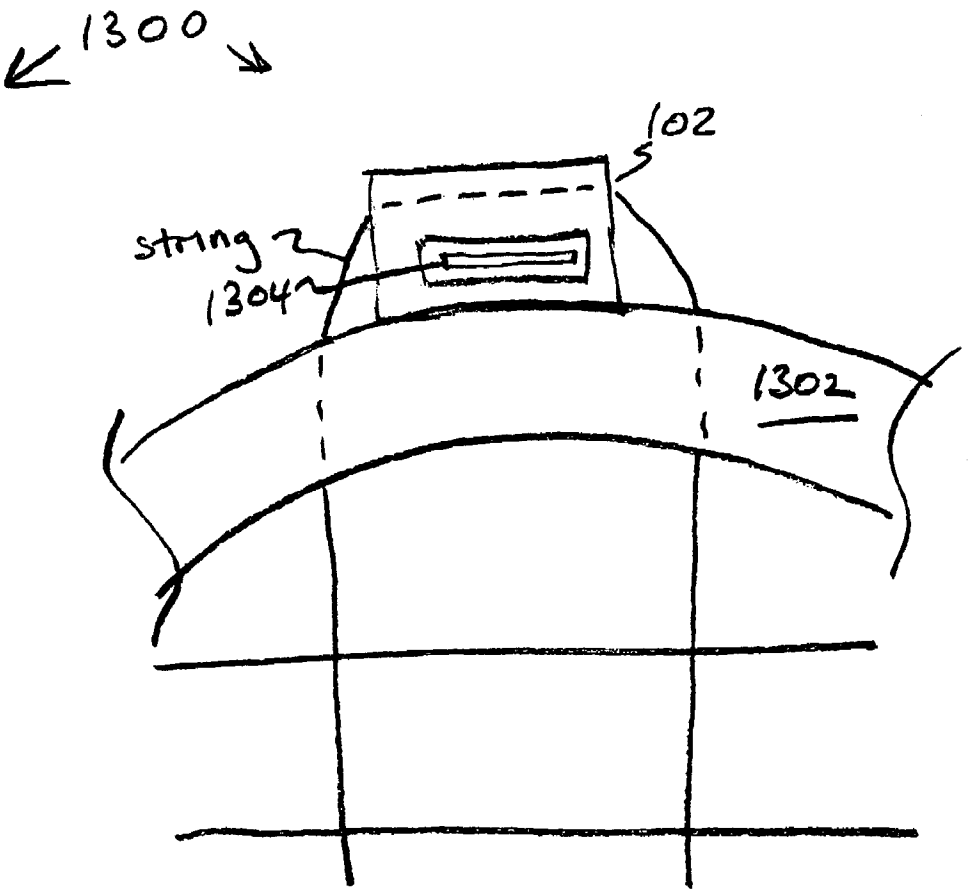
FIGS. 15A and 15B are orthogonal cross-sectional views of string overlay variation of the assembly
Figure 15A:
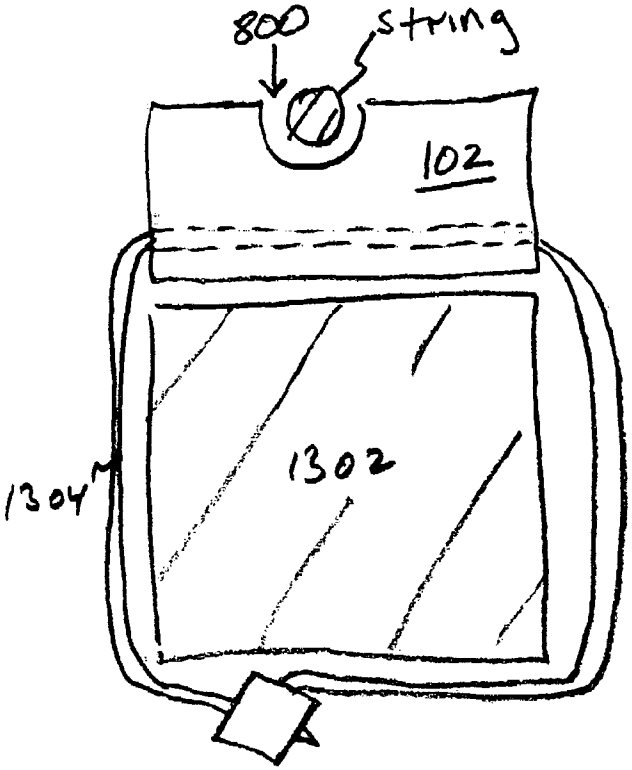

FIGS. 15A and 15B are orthogonal cross-sectional views of string overlay variation of the assembly. The ARS 102 has a channel 800 formed in the outside surface length 106, for accepting a racket string 1500.

Figure 16B:
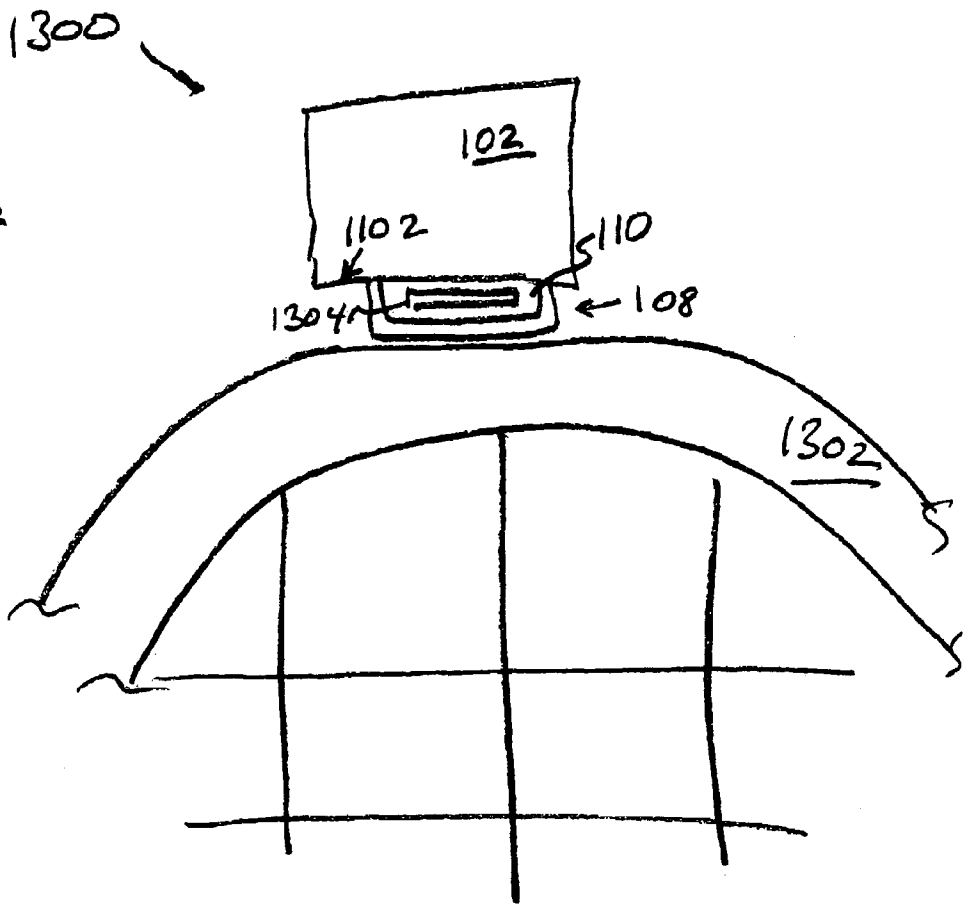
FIGS. 16A and 16B are orthogonal cross-sectional views of the collar flange variation of the assembly.
Figure 16A:
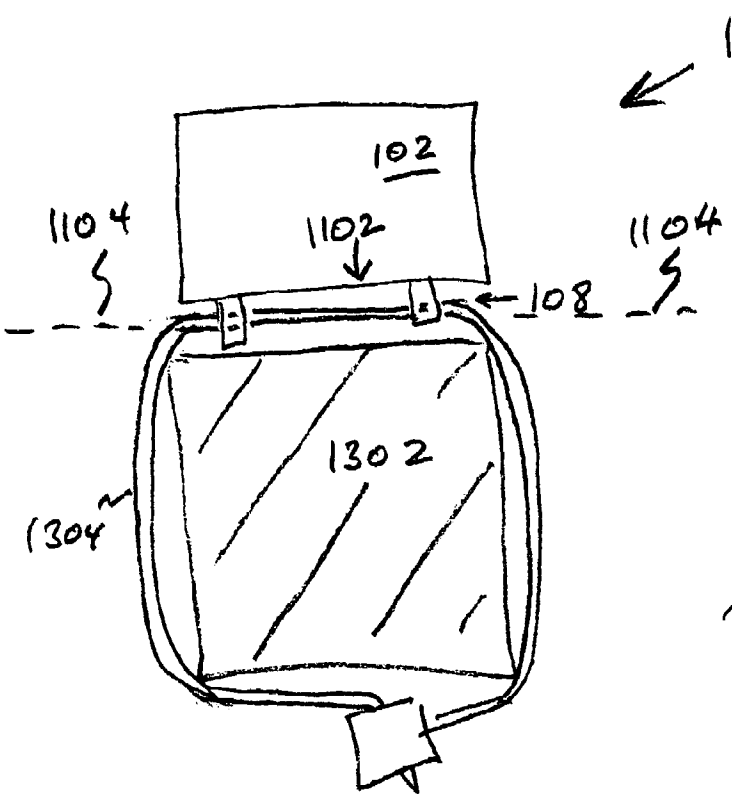

FIGS. 16A and 16B are orthogonal cross-sectional views of the collar flange variation of the assembly. The ARS 102 has a frame interface surface 1102. A plurality of collars 108 extend as flanges from the frame interface surface 1102. A plurality of fastener cavities 110 is aligned along a single axis 1104, cooperating to accept the fastener strip 1304.

Figure 17D:
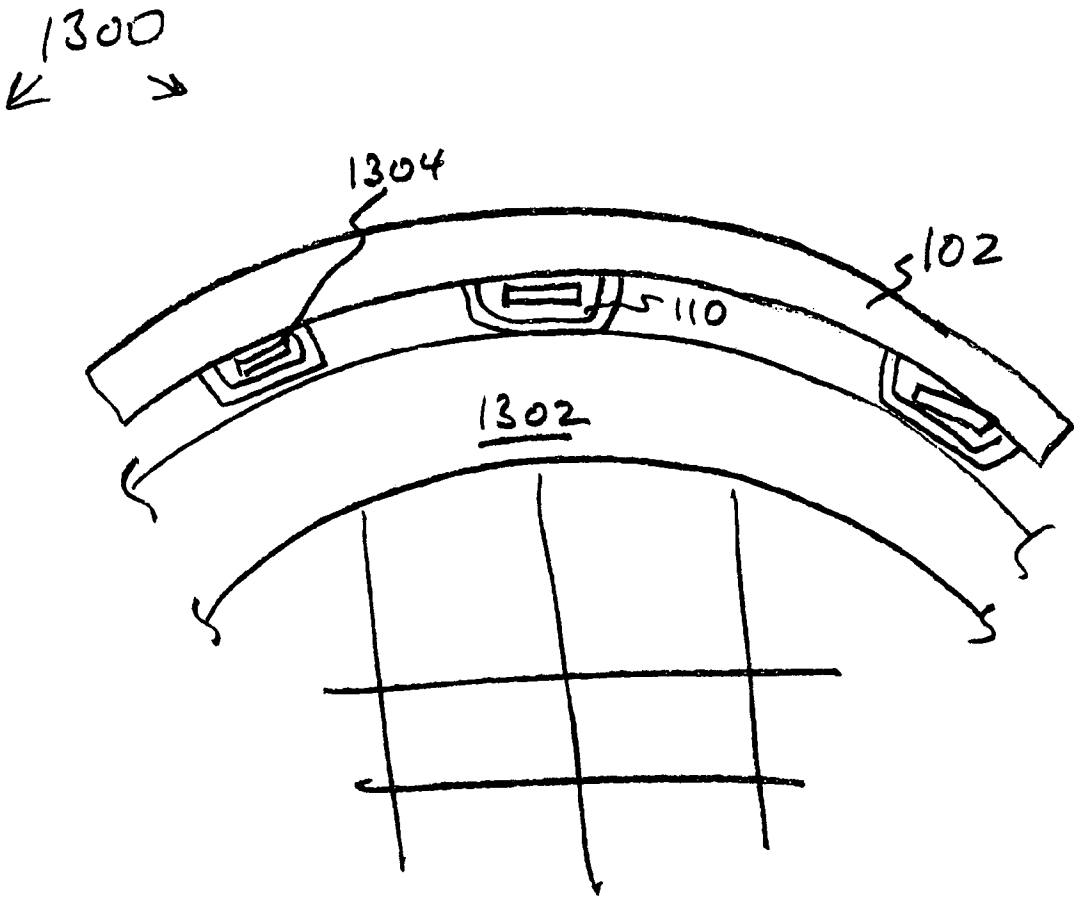
Figure 17C:
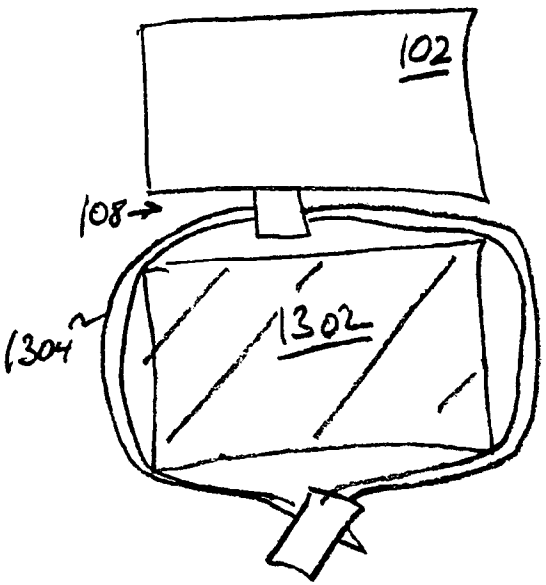

FIGS. 17A through 17D are orthogonal cross-sectional views of the parallel collar variation of the assembly. A plurality of collars 108 is formed with the ARS 102. A plurality of fastener cavities 110 is aligned along parallel axes. A corresponding plurality of fastener strips 1304 is insertible through the plurality of fastener cavities 110. FIGS. 17C and 17D show collars 108 formed as flanges.

FUNCTIONAL DESCRIPTION

Figure 18:
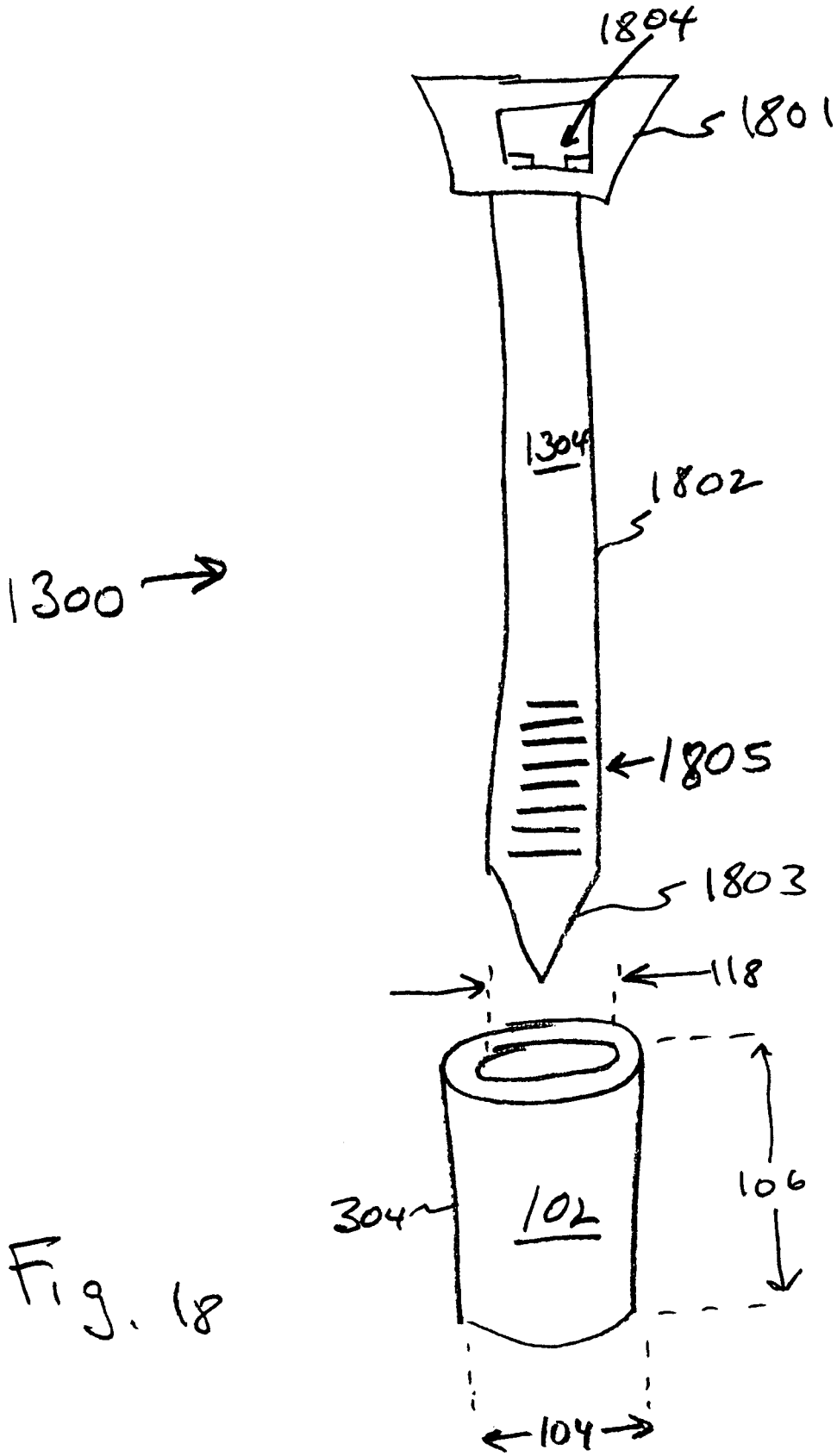
FIG. 18 is a perspective drawing of the frame guard assembly.

FIG. 18 is a perspective drawing of the frame guard assembly. As described above, the assembly is a two-part device joined together to form a guard for a racket frame comprising of a fastener strip and an abrasion resistant section (ARS). One possible example of the fastener strip is a flexible strip of material with a fastening system similar to a cable tie as shown in the figure. The specific size, length, width, tensile strength, fastening system, and material can vary against the existing varieties of cable ties, tie wraps, and clamping devices. The fastening system can also utilize a releasable or "low profile" design, which can be found in some conventional cable ties.

The ARS is shown as tubing. The ARS design can be tailored to cover a small, or large portion of the racket head, and to be secured with either one fastener strip, or a combination of two or more strips. The ARS may also be designed to slide up or down the fastener strip/s to a desired location on the strip or be pre-bonded to a specific area on the strip. Although the ARS is shown as tubular, in other aspects it may utilize a flexible solid piece or any abrasive resistant material that is secured to the strip in a variety of ways, such as a slit through which the strip is passed, or adhesives that hold the ARS to the strip, or sprayed/melted onto the strip. A variety of lengths, thickness, and materials can be used for the ARS, and different material can be used on the outer and inner surfaces, for adaptation to different racket shapes, type of damage, and player styles.

The use of a fastener strip, in combination with an abrasion resistant section, makes it possible to secure a fit to any type of racket (tennis, racquetball, squash, etc.) with minimal bulk and weight. Combining the strip with the ARS provides reinforced, durable protection that extends the wear and tear life of the guard. The assembly can be located on the frame responsive to the specific players needs.

The fastener strip 1304 shown in FIG. 18 has a head 1801, a body 1802, a tail 1803, and a tab 1804. The head 1801 may use a number of different fastening means. As shown, there is a cavity formed through which the tail 1803 can be inserted. Teeth 1805 are formed on the tail 1803, which engage the tab 1804, locking the body 1802 in place, as is conventional with many cable ties. The tab 1804 may allow the teeth 1805 to pass through the head (1801) in a direction that cinches or tightens the strip 1304, but that cannot be reversed unless the tab 1804 is released. The tail 1803 may simply be a tapered extension of the body 1802 that permits easy insertion into the head 1801. In other aspects, the tab 1804 is a release tab that permits the tail 1803 to be pulled back out of head 1801, after it has been inserted and secured. Although a cable tie fastener strip is shown, other fastener strip devices may be used in the assembly, such as a hose clamp, a tie wrap, a twist tie, lever latch, or the like.

The abrasion resistant section (ARS) 102 shown here is tubular. Other tubular and non-tubular ARS types may be used and secured to the fastener strip in various ways (adhesives, slits in the ARS, bonding methods, etc.) prior to attachment to the racket. Alternately, the ARS 102 is permitted to slide freely along the length of the strip body. The ARS may be designed with differing lengths 106, outside diameters 104, inside surface or fastener cavities diameters 118, and inside/outside diameters ratios. In other variations, the ARS 102 is secured using two or more fastener strips. Further, a reinforcement material can be inserted into the tubular sleeve along the outer portion of the strip, or placed on the outside surface 304 of the ARS 102 for added durability. Different materials may also be used on the ARS between the strip and racket to allow for padding, to resist the strip from slipping around or along the frame, or for the absorption of racket frame vibration due to impact with the ball.

Figure 19:
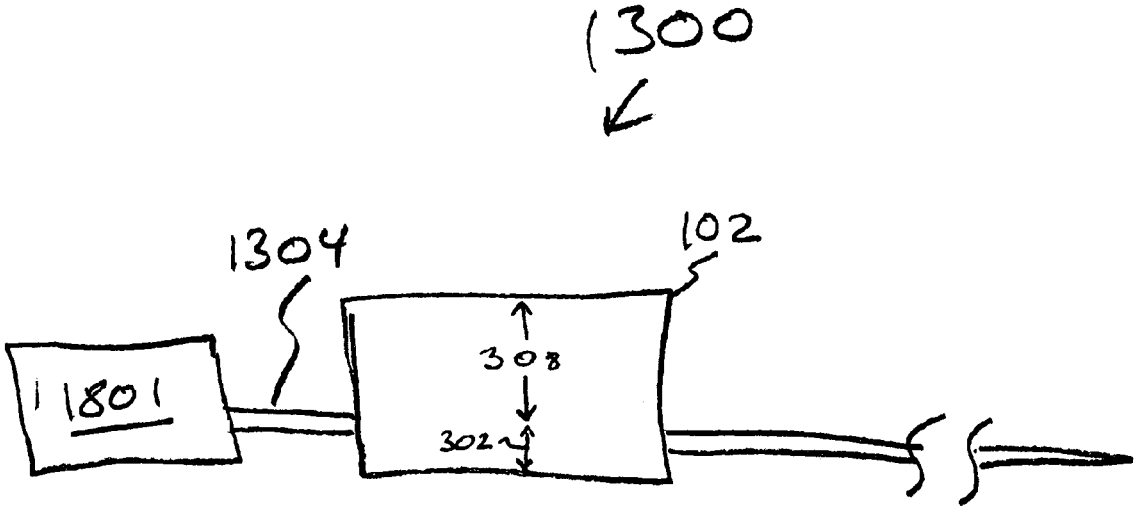
FIG. 19 is a partial cross-sectional view showing the ARS positioned on the fastener strip.

FIG. 19 is a partial cross-sectional view showing the ARS positioned on the fastener strip. In this figure the ARS 102 is shown to have a greater thickness on the top of the strip than under the strip. That is, the contact section thickness 308 is greater than the frame interface section thickness 302. The thicknesses of the ARS can be varied to add durability and wear to the contact section, which comes in contact with the ground. Further, the frame interface section can be a padding or non-slip material, to reduce movement of the strip along or around the frame, or to absorb racket frame vibrations due to ball impact.

Figure 20:
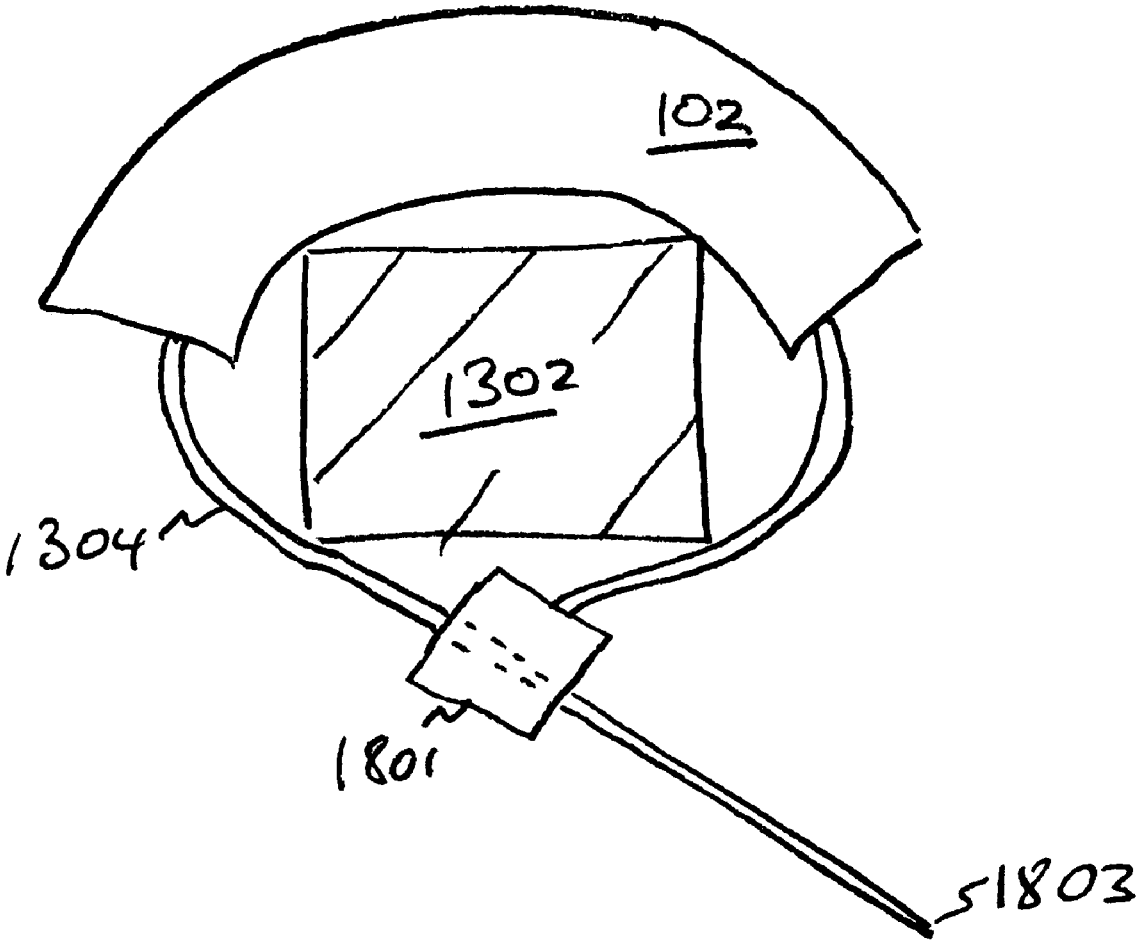
FIG. 20 is a partial cross-sectional view of a conventional racket frame with the fastener strip and wrapped around the frame.

FIG. 20 is a partial cross-sectional view of a conventional racket frame 1302 with the fastener strip 1304 and ARS 102 wrapped around the frame. The fastener strip body and tail can be inserted into the hole and pulled as tight as needed. This operation leaves an excess length of the strip body and/or tail that can be cut near the head of the strip once the desired positioning is set. The ARS portion of the strip can be located on the exterior edge of the racket frame to serve as the protection device for avoiding scraping the racket on the playing surface. The fastening system on the strip can be located on the inner edge of the racket frame where the strings extend toward the center of the racket.

Figure 21:
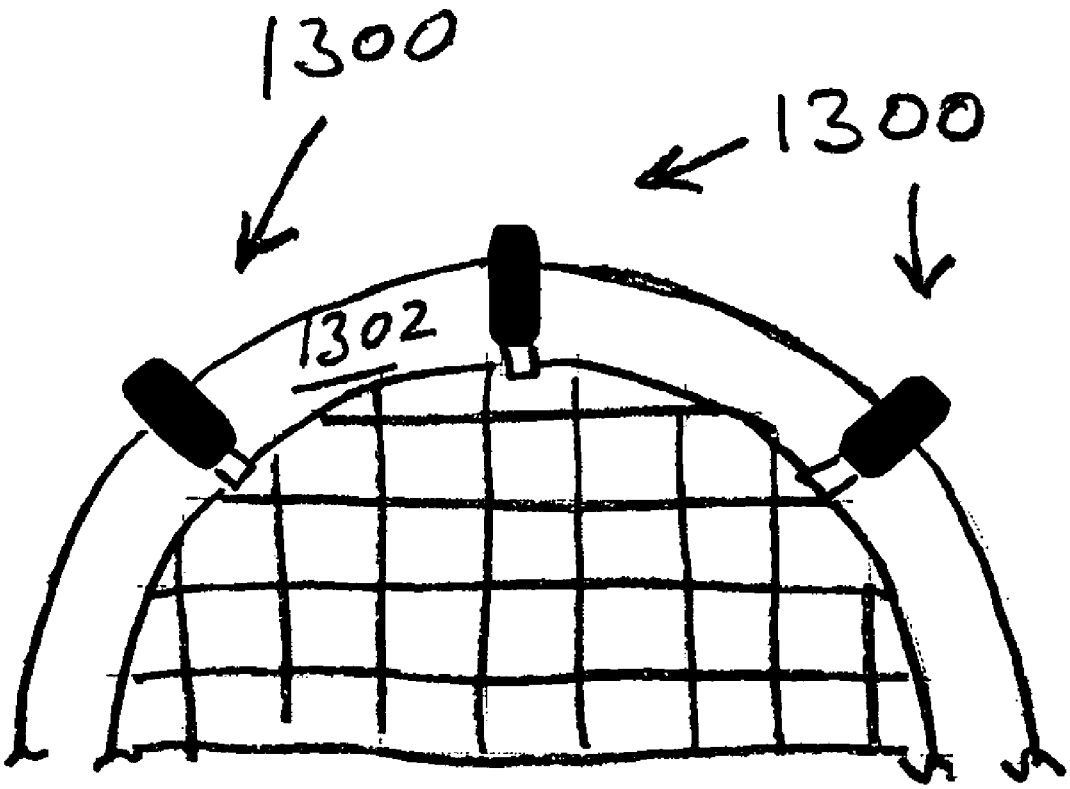
FIG. 21 is a plan view of conventional racket head with frame guard assemblies located along the racket frame.

FIG. 21 is a plan view of conventional racket head with frame guard assemblies located along the racket frame. The number of frame guard assemblies and the location of the assemblies are selectable. Any number of assemblies can be used in any number of locations along the entire racket frame. The individual using the invention is able to position more assemblies in locations of greater wear, and fewer assemblies in places that are not worn based on swing style or playing habits.

Figure 23B:
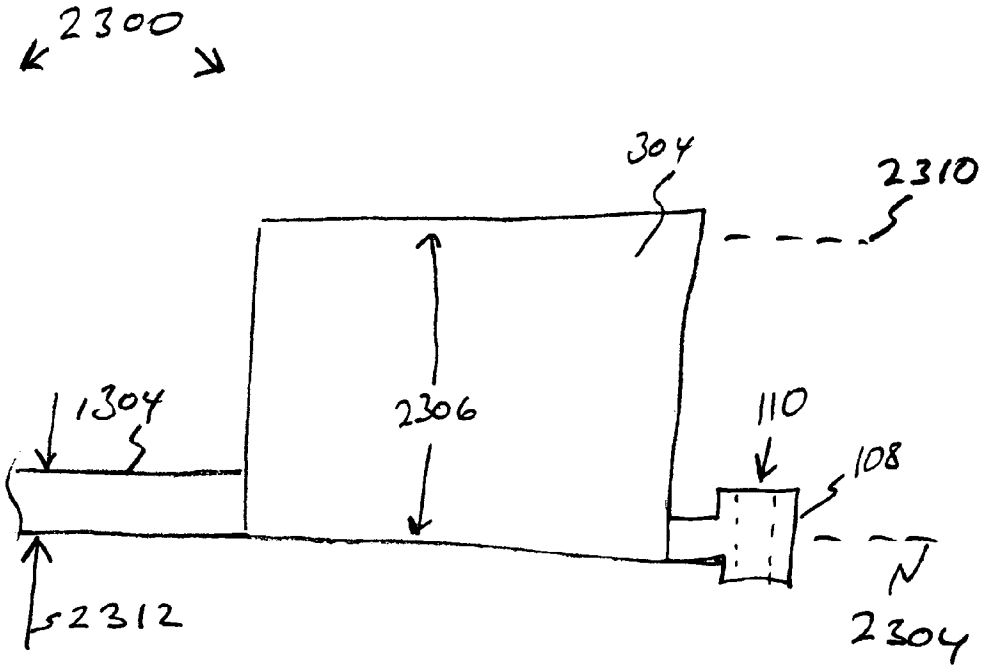
FIGS. 23A and 23B are orthogonal partial cross-sectional views a racket frame bumper guard single-piece assembly.
Figure 23A:
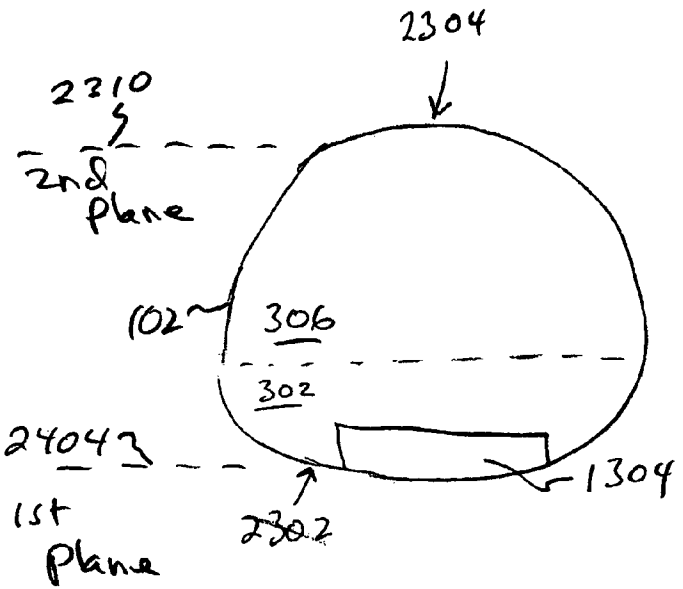

FIG. 23A and 23B are orthogonal partial cross-sectional views a racket frame bumper guard single-piece assembly. The assembly 2300 comprises an ARS 102 having a frame interface section 302 with a surface 2302 in a first plane 2304, for covering an outside portion of a racket frame. The assembly 2300 further comprises a contact section 306 with a contact surface 2308 in a second plane 2310. Note, surfaces 2302 and 2308 are both part of the overall outside surface 304. The assembly 2300 also includes a fastener strip 1304 having a length sufficient to wrap around a radial circumference of the racket frame, to secure the ARS. Also shown is a collar 108 with a fastener cavity 110 for accepting and securing the fastener strip 1304.

The ARS 102 has a first thickness 2306 between the ARS contact section surface 2308 and frame interface section surface 2302. Typically, the fastener 1304 has a second thickness 2312, less than the first thickness. The thicker ARS 102 helps prevents the fastener strip from being skinned and weakened when the racket makes contact with the court. This arrangement also permits the fastener strip 1304 to be flexible. A flexible fastener strip permits the assembly to be fixed to a racket more securely.

Figure 24:
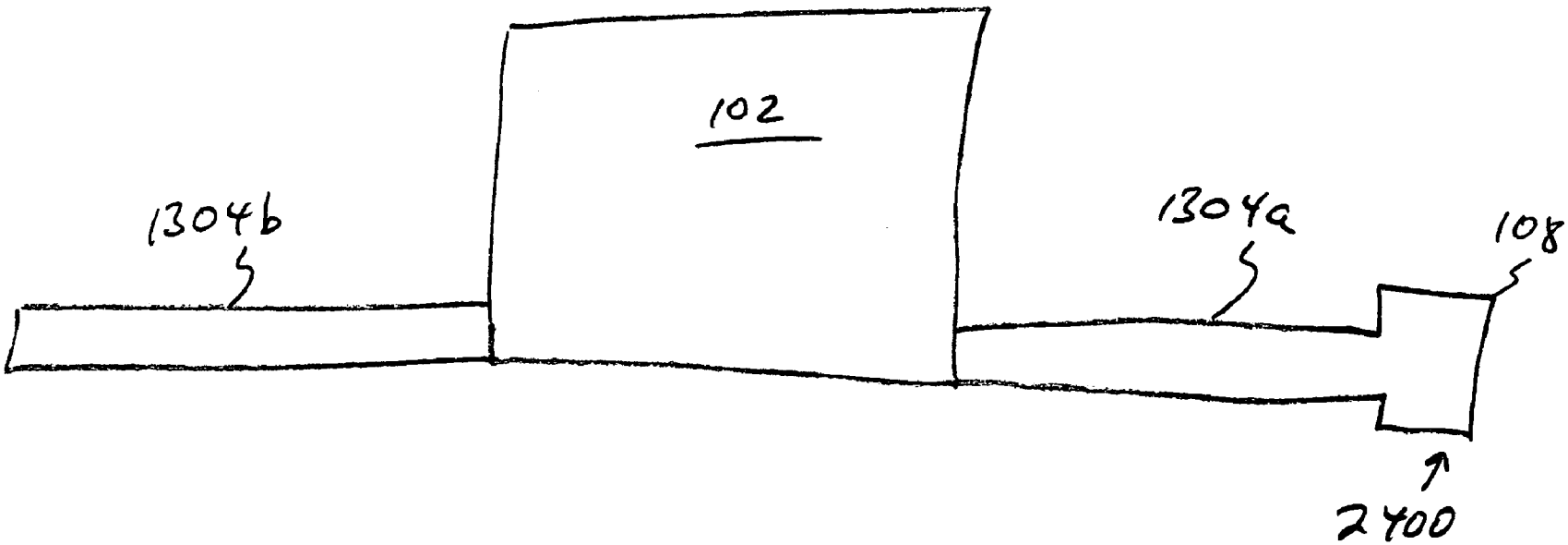
FIG. 24 is a partial cross-sectional view a variation of the racket frame guard of FIG. 23B.

FIG. 24 is a partial cross-sectional view a variation of the racket frame guard of FIG. 23B. As shown, two fastener strips 1304*a* and 1304*b* extend from the ARS 102. The collar 108 is attached to the distal end 2400 of fastener strip 1304a. Note, many of the variations specifically shown and explained above for the two-piece assembly also apply the one-piece assembly 2300 of FIGS. 23A, 23B, and 24, but will not be repeated again in the interest of brevity. For example, the one-piece assembly may use a plurality of fastener strips. The one-piece assembly can also be shaped in any of the two-piece variations, formed with a groove flange, or string channel, for example.

Figure 25B:
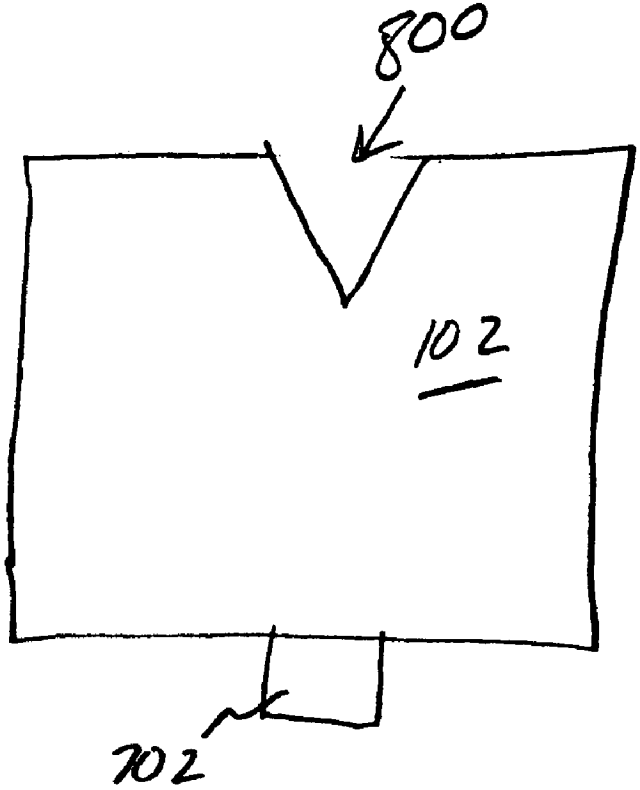
FIGS. 25A and 25B are orthogonal partial cross-sectional views of a racket frame bumper guard with both the string channel and groove flange options.
Figure 25A:
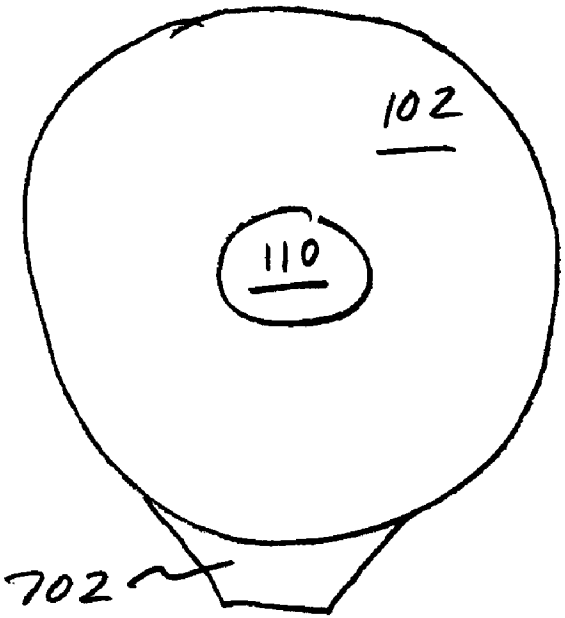

FIG. 25A and 25B are orthogonal partial cross-sectional views of a racket frame bumper guard with both the string channel and groove flange options. This variation includes the grove flange 702 shown in FIGS. 7A and 7B, as well as the string channel 800 shown in FIG. 8B. That is, the racket frame guard comprises a ARS 102 having a tubular-shape with an inside surface formed along an interior axis, an outside surface with a length, a contact section, and a frame interface section for covering an outside portion of a racket frame. A collar with a fastener cavity 110 is formed by the ARS inside surface, for accepting a fastener strip. A groove flange 702 extends from the ARS frame interface section outside surface, bisecting the frame interface section outside surface length, for securing the ARS to a groove in the frame outside portion. A channel 800 is formed in the ARS contact section outside surface length, for accepting a racket string.

Figure 26:
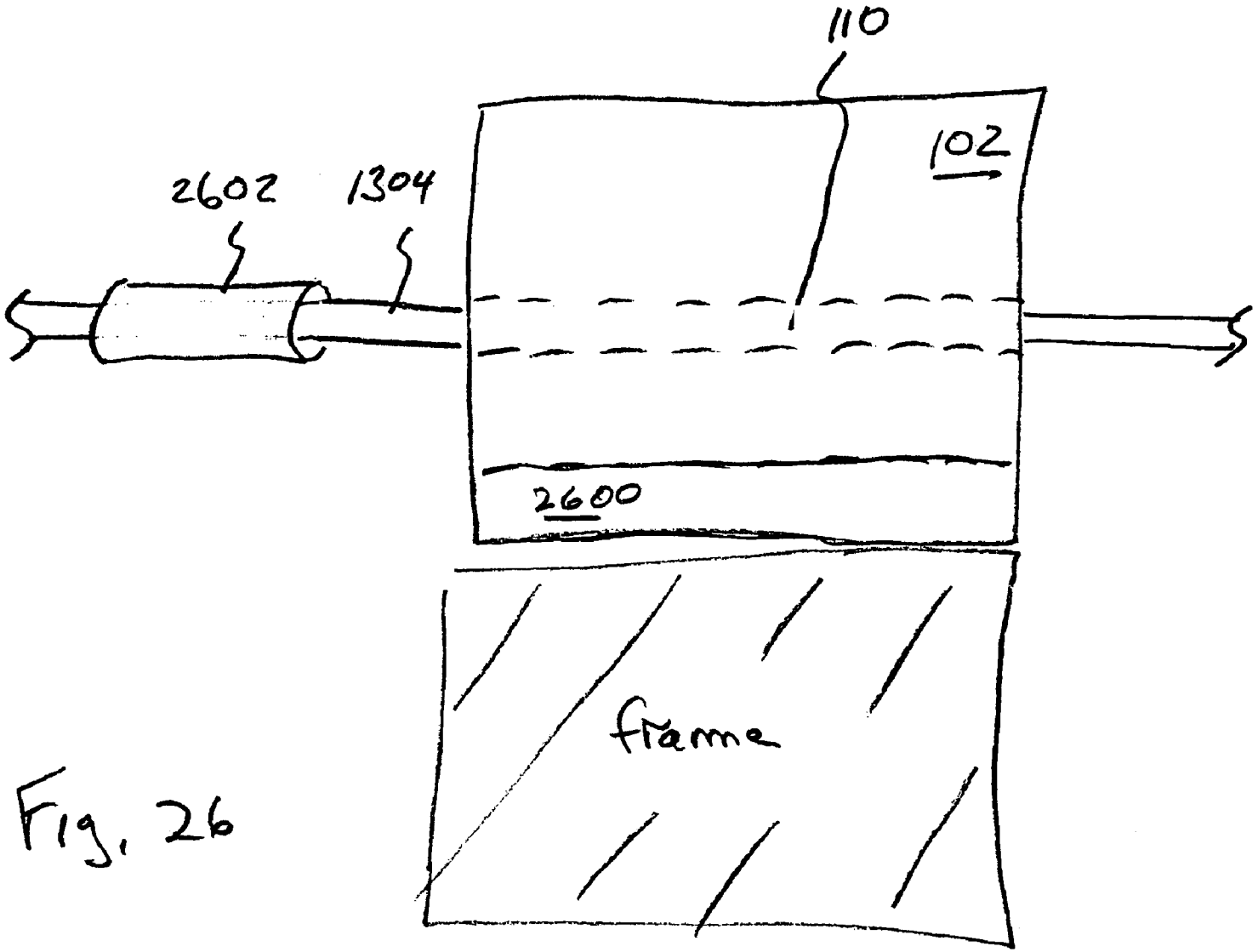
FIG. 26 is a partial cross-sectional depicting a weighted frame guard assembly variation.

FIG. 26 is a partial cross-sectional depicting a weighted frame guard assembly variation. In this aspect a weighted element is used. The weighted element can be a weighted section 2600 that is secured between the ARS 102 and a racket frame. In this aspect the weighted section can be attached to the ARS for ease of handling. Alternately, the weighted section can be independent of the ARS. This variation would permit a user to build up the weight to their own unique requirements. In a different aspect, a weighted tape 2602 can be mounted on the fastener strip 1304. For example, the weighted tape 2602 can be formed as a sleeve as shown, or the tape can have an adhesive backing to stick on the fastener strip 1304 (not shown). Alternately, the tape can be held in place by compression between the fastener strip and racket. Note, in other aspects both the weighted tape 2602 and weighted section 2600 can be used together. In one aspect, the weighted element can be made from a lead material, which is both relatively heavy and flexible. However, the invention is not limited to any particular material type. This aspect of the invention permits a player to control the overall weight, and the placement of weights upon their racket.

Figure 27B:
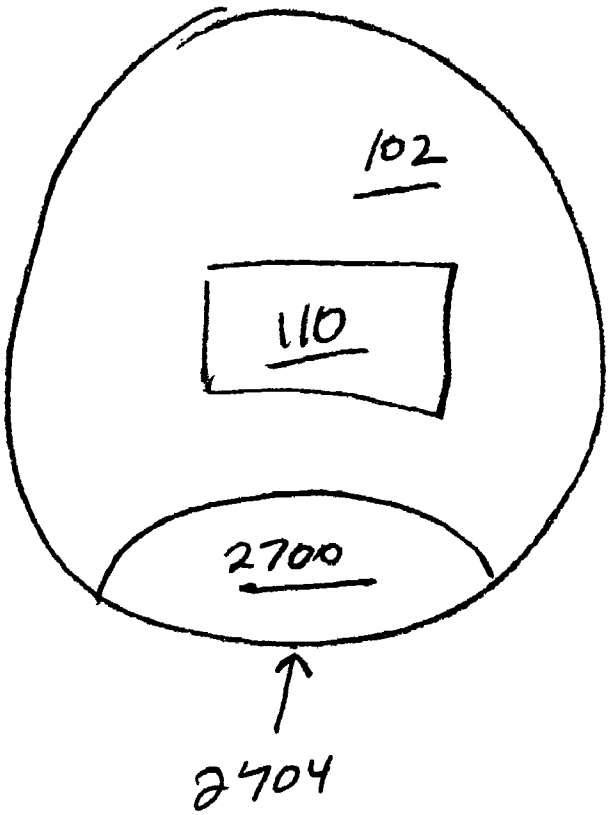
FIGS. 27A and 27B are partial cross-sectional views of a frame guard with an embedded weighted section.
Figure 27A:
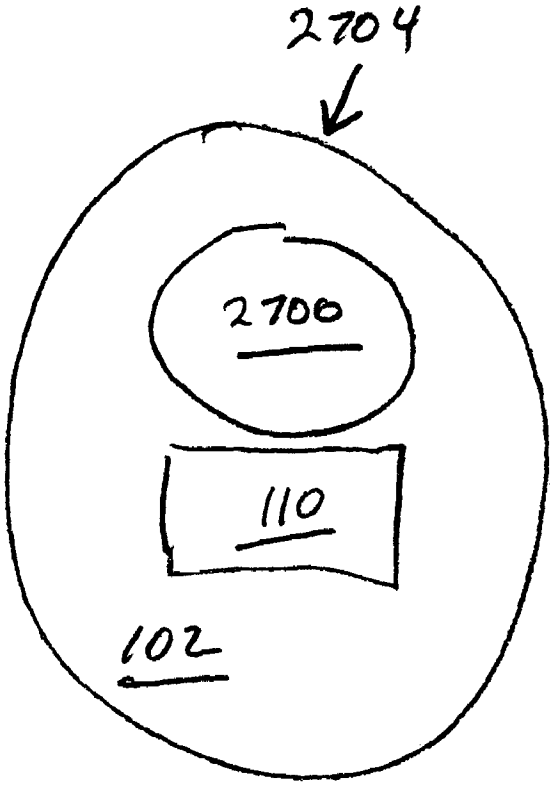

FIGS. 27A and 27B are partial cross-sectional views of a frame guard with an embedded weighted section. As shown in FIG. 27A, the weighted section 2700 is embedded in an area of the ARS 102 between the fastener cavity 110 and the contact section surface 2702. In FIG. 27B, the weighted section 2700 is embedded between the fastener cavity 110 and the frame interface section surface 2704. In other aspect not shown, the weight section can be embedded adjacent (to the side of) the fastener cavity, or embedded in multiple regions of the ARS.

Figure 22:
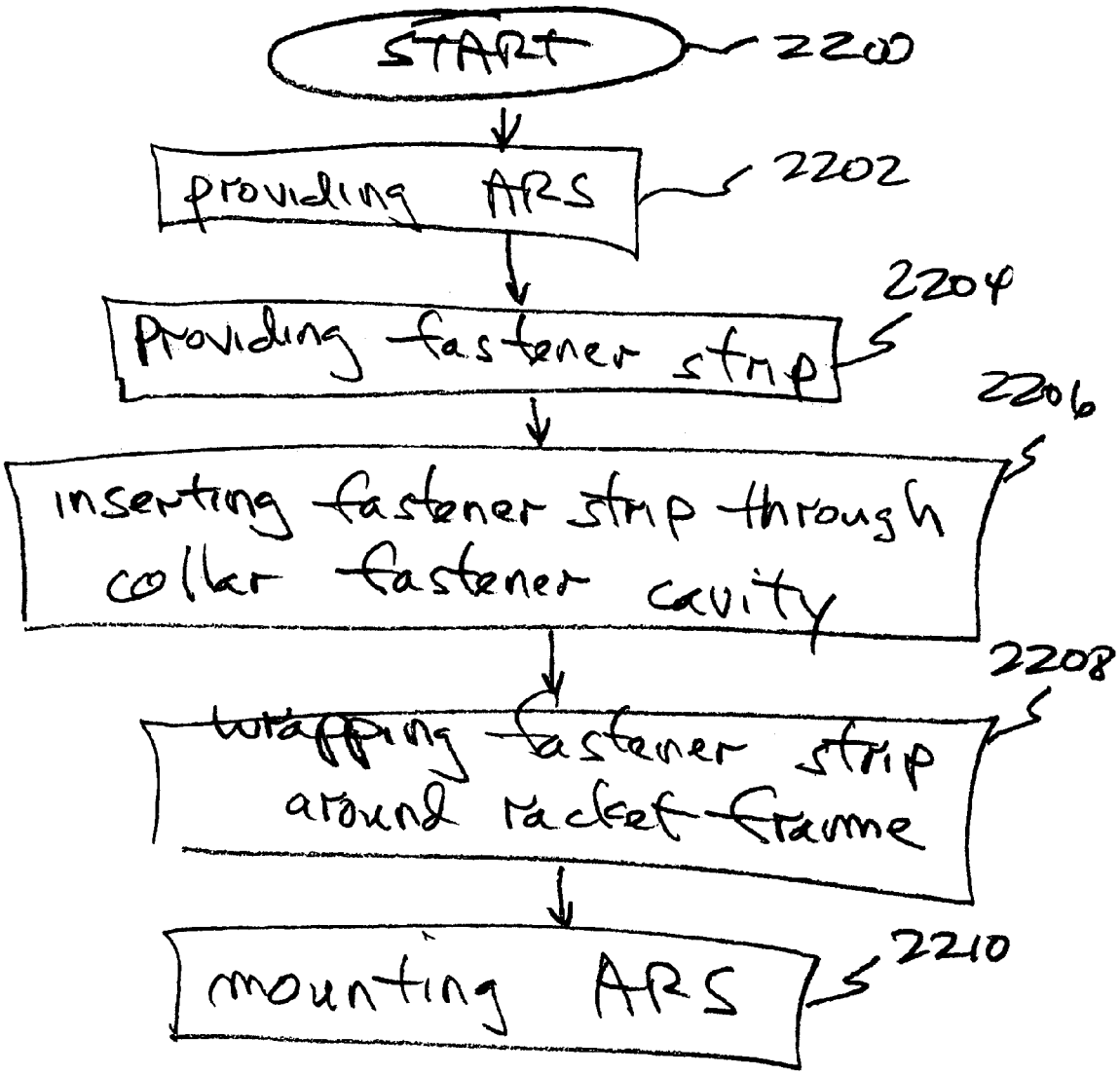
FIG. 22 is a flowchart illustrating a method for attaching a racket frame bumper guard assembly to a racket frame.

FIG. 22 is a flowchart illustrating a method for attaching a racket frame bumper guard assembly to a racket frame. Although the method is depicted as a sequence of numbered steps for clarity, no order should be inferred from the numbering unless explicitly stated. It should be understood that some of these steps may be skipped, performed in parallel, or performed without the requirement of maintaining a strict order of sequence. The method starts at Step 2200.

Step 2202 provides a frame guard comprising a flexible abrasion-resistant section (ARS) and a collar with a fastener cavity, formed with the ARS. Step 2204 provides a fastener strip. Step 2206 inserts the fastener strip through the collar fastener cavity. Step 2208 wraps the fastener strip around a radial circumference of the racket frame. Step 2210 mounts the ARS on an outside portion of the racket frame, in response to wrapping the fastener strip.

A racket frame bumper guard and a frame bumper guard assembly have been provided. Examples of particular shapes and dimensions have been given to help illustrate the invention. Likewise, examples have been given of particular materials and application uses. However, the invention is not limited to merely these examples. Other variations and embodiments of the invention will occur to those skilled in the art.

I claim:

1. A racket frame bumper guard assembly comprising:

a tubular-shaped flexible abrasion-resistant section (ARS) for covering an outside portion of a racket frame, having an outside surface length;

a collar with a fastener cavity, formed through the ARS and aligned with the ARS outside surface length;

a fastener strip, insertible through the collar fastener cavity, having a length sufficient to wrap around a radial circumference of the racket frame, to secure the ARS; and a groove flange extending from the outside surface, bisecting the outside surface length, for securing the ARS to a groove in the frame outside portion.

2. The assembly of claim 1 wherein the ARS comprises a plurality of collars extending as flanges from the frame interface surface, with a corresponding plurality of collar fastener cavities aligned along a single axis, cooperating to accept the fastener strip.

3. The assembly of claim 1 wherein the fastener strip is a device selected from the group including a cable tie, tie wrap, a hose clamp, a twist tie, Velcro strip, Velcro tie wrap, a wire, and a string.

4. The assembly of claim 1 wherein the ARS is made from a material selected from the group including polyurethane, thermal plastics, and cast polyurethane plastics.

5. The assembly of claim 1 further comprising:

a weighted element selected from the group comprising:

a weighted section, secured between the ARS and a racket frame; and a weighted tape mounted on the fastener strip.

6. A racket frame guard comprising:

a tubular-shaped flexible abrasion-resistant section (ARS) having an outside surface length for alignment with a racket frame radial circumference when covering an outside portion of the racket frame; and a plurality of collars extending as flanges from a frame interface surface, with the plurality of corresponding collar fastener cavities formed through the ARS and aligned with the ARS outside surface length along a single axis, cooperating to accept a fastener strip.

7. The frame guard of claim 6 wherein the ARS has a tubular-shape with an inside surface formed along an interior axis; and wherein the collar fastener cavity is formed by the ARS inside surface.

8. The frame guard of claim 7 wherein the ARS has a frame interface section with a first thickness between an ARS outside surface and the inside surface, and a contact section with a second thickness between the inside and outside surfaces, greater than the first thickness.

9. The frame guard of claim 8 wherein the ARS frame interface section outside surface is flat.

10. The frame guard of claim 7 wherein the ARS has an outside surface length; and the racket frame guard further comprising:

a groove flange extending from the ARS outside surface, bisecting the outside surface length, for securing the ARS to a groove in the frame outside portion.

11. The frame guard of claim 8 wherein the ARS has an outside surface diameter in the range of about 9/32 and 1 inch, and an outside surface length in the range of about 1 to 2 inches.

12. The frame guard of claim 6 wherein the ARS is made from a material selected from the group including polyurethane, thermal plastics, and cast polyurethane plastics.

13. The frame guard of claim 6 further comprising a weighted section embedded in the ARS.

14. A racket frame guard assembly comprising:

a flexible abrasion-resistant section (ARS) having a frame interface section with a planar surface in a first plane, for covering an outside portion of a racket frame, and a contact section with a planar contact surface in a second plane;

a collar with a fastener cavity formed through the ARS, for accepting a fastener strip; and a fastener strip, insertible through the fastener cavity, having a length sufficient to wrap around a radial circumference of the racket frame, to secure the ARS.

15. The assembly of claim 14 wherein the ARS has a first thickness between an ARS contact section surface and frame interface section surface; and wherein the fastener has a second thickness, less than the first thickness.

* * * * *